US005111014A

United States Patent [19]

Tanaka et al.

[11] Patent Number: 5,111,014

[45] Date of Patent: May 5, 1992

[54] ELECTROMAGNETIC COOKER INCLUDING LOAD CONTROL

[75] Inventors: Teruya Tanaka; Yoshiyuki Noguchi, both of Yokohama, Japan

[73] Assignee: Kabushiki Kaisha Toshiba, Kawasaki, Japan

[21] Appl. No.: 363,963

[22] Filed: Jun. 9, 1989

[30] Foreign Application Priority Data

Jun. 14, 1988 [JP] Japan ..... 63-144779
Jun. 14, 1988 [JP] Japan ..... 63-146530

[51] Int. Cl.[5] ..... H05B 6/08

[52] U.S. Cl. ..... 219/10.77; 219/10.493; 363/37; 363/95

[58] Field of Search ..... 219/10.77, 10.493; 363/37, 95, 96, 97

[56] References Cited

U.S. PATENT DOCUMENTS

| | | | |
|---|---|---|---|
| 4,016,390 | 4/1977 | Amagami et al. | 219/10.493 |
| 4,277,667 | 7/1981 | Kiuchi | 219/10.49 |
| 4,320,273 | 3/1982 | Kiuchi | 219/10.493 |
| 4,352,000 | 9/1982 | Fujishima et al. | 219/10.77 |
| 4,356,371 | 10/1982 | Kiuchi et al. | 219/10.77 |
| 4,429,205 | 1/1984 | Cox | 219/10.77 |
| 4,430,542 | 2/1984 | Kondo et al. | 219/10.77 |
| 4,456,807 | 6/1984 | Ogino et al. | 219/10.77 |
| 4,467,165 | 8/1984 | Kiuchi et al. | 219/10.77 |
| 4,626,978 | 12/1986 | Thouvenin | 219/10.77 X |

FOREIGN PATENT DOCUMENTS

| | | |
|---|---|---|
| 53-44060 | 11/1978 | Japan . |
| 54-48346 | 4/1979 | Japan . |
| 55-159589 | 12/1980 | Japan . |
| 59-8147 | 2/1984 | Japan . |
| 2835328 | 2/1979 | United Kingdom . |

*Primary Examiner*—Philip H. Leung
*Attorney, Agent, or Firm*—Foley & Lardner

[57] ABSTRACT

In an electromagnetic cooking apparatus, low heating power control is carried out by turning ON/OFF a DC power supply circuit, or rectifier circuit, at a commercial frequency lower than an inverting frequency of DC/AC inverter. The electromagnetic cooking apparatus includes: a DC (direct current) power supply for producing DC power from low-frequency AC (alternating current) power; a DC-to-AC inverting circuit coupled to the DC power supply and including a switching element and also a heating coil, for inverting the DC power inputted from the DC power supply into high-frequency AC power so as to heat a metal pan by energizing the heating coil with the high-frequency AC power, thereby electromagnetically inducing eddy currents within the metal pan; a monitoring circuit for monitoring switching conditions of the switching element so as to output a switching condition signal; and an ON/OFF-controlling circuit for turning ON/OFF power supply operation of the DC power supply, or inverting operation of the DC/AC inverter circuit in response to the switching condition signal at a timing period defined by a time constant smaller than a thermal time constant determined by a heat capacity of a metal material of the pan.

33 Claims, 19 Drawing Sheets

FIG.11A
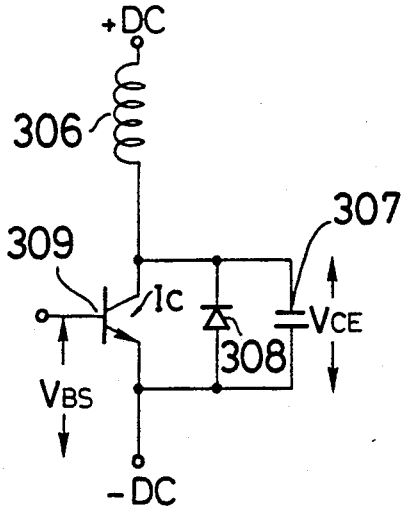
FIG.11B
FIG.11C
FIG.11D
FIG.11E
FIG.11F
FIG.11G
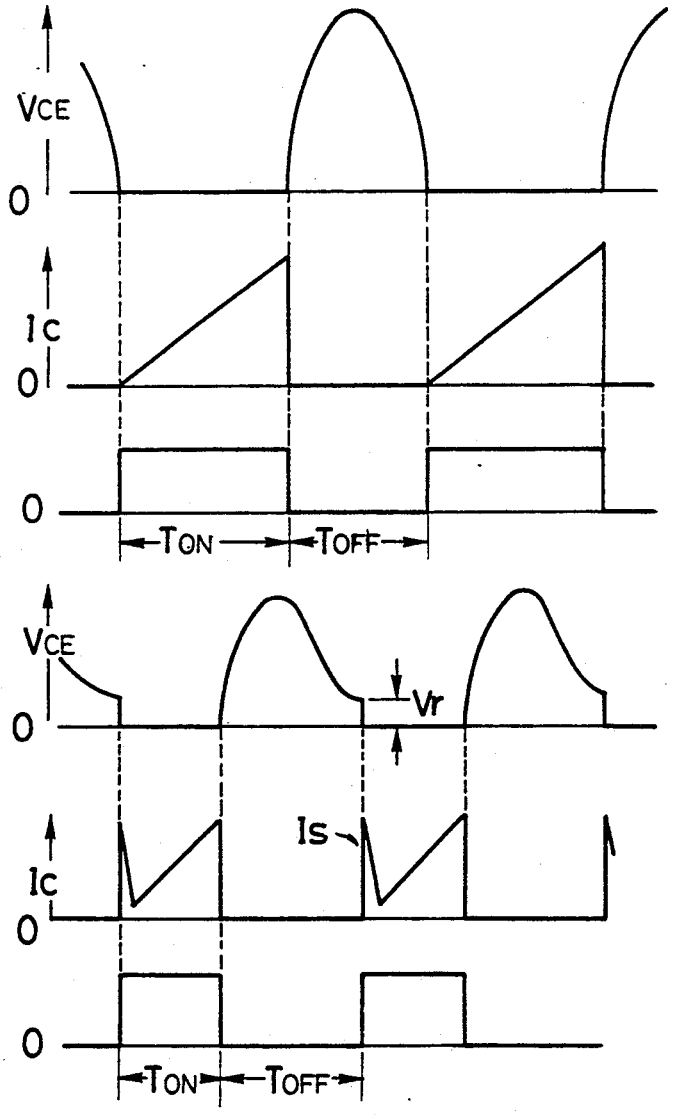

ELECTROMAGNETIC COOKER INCLUDING LOAD CONTROL

BACKGROUND OF THE INVENTION

1. Field of the Invention

The present invention generally relates to an electromagnetic cooking apparatus capable of heating food in a metal pan by utilizing eddy currents occurred in the metal pan. More specifically, the present invention is directed to an electromagnetic cooking apparatus capable of uniformly heating the food even under low power consumption, and also capable of quickly detecting various sorts of heating loads.

2. Description of the Related Art

Various types of electromagnetic cooking apparatuses for utilizing an electromagnetic induction effect to heat food or the like have been developed and marketed with the following advantages. No flame is needed to heat food or the like, i.e., a safety factor in view of fire problems. A top plate to mount an article to be electromagnetically heated, such as a metal pan, can be made of a crystallized glass, for clean cooking. Furthermore higher heat efficiency can be achieved.

In FIG. 1, there is shown a circuit diagram of one conventional electromagnetic cooking apparatus. A predetermined DC voltage derived from a DC (direct current) power supply circuit 101 is applied to a DC-to-AC inverter circuit 103. While a transistor 113 is turned ON/OFF by a drive circuit 115, both a heating coil 107 and a resonance coil 109 are set to a series resonance condition, and a heating operation is carried out in such a manner that eddy currents are produced in an article to be heated such as an iron pan 100 by the electromagnetic induction effect caused by the magnetic flux produced in the heating coil 107.

A pulse width modulation circuit 119 including an oscillator (not shown in detail) adjusts an oscillation period of an oscillating pulse derived from the oscillator in response to a timing pulse from a voltage feedback circuit 117, and also modulates a pulse width of the oscillating pulse in response to a signal from signals derived from an input setting circuit 121 and an ON-time setting circuit 123. The drive circuit 115 will turn ON the switching transistor 113 for a time duration corresponding to the pulse width of the PWM (pulse width modulated) pulse signal from the PWM circuit 119.

An input current monitoring circuit 127 outputs to a load detecting circuit 125, a signal corresponding to an input current from an AC power supply unit, namely a current "ic" flowing through an inverter circuit 103 based upon a detection signal from a current transformer CT electromagnetically coupled to the AC power supply unit.

The load detecting circuit 125 monitors the loading condition in response to the signal corresponding to the current "ic" from the input current monitoring circuit 127. As shown in FIG. 2A, for instance, since the proper current "ic" flows through the heating coil 107 on which the iron pan 100 has been mounted, it is judged that the proper load is loaded on the heating coil 107 and thus the operation of the pulse width modulation circuit 119 is continued. As represented in FIGS. 2A and 2C, when either an aluminum pan (not shown in detail), or no pan is mounted on the heating coil 107, the current "ic" flowing therethrough becomes small, or a regenerative current "id" having no heating function flows through the heating coil, 107. It is therefore judged that a no loading condition, or an improper load, is loaded applied to the heating coil 10. Thus, operation of the pulse width modulation circuit 119 is interrupted, to prohibit the heating operation by the heating coil 107.

In another conventional electromagnetic cooking apparatus shown in FIG. 3, an initialization circuit 131 is actuated when a power supply unit is energized, and an oscillation stopping circuit 135 is operated for a predetermined time duration set by an oscillation stopping timer 133 so as to stop the oscillation by the DC/AC inverter 103. Thereafter, when the oscillation stopping circuit 135 has recovered, the voltage "$V_{TON}$" which has been set by an ON-time setting circuit 123 is applied to the pulse width modulation circuit 119. When the pulse width modulation circuit 119 outputs a pulse signal having a pulse width corresponding to the voltage $V_{TON}$, the switching transistor 113 is turned ON for a time duration corresponding to the pulse width of this pulse signal by the drive circuit 115. As a result, based upon the value of the voltage $Y_{TON}$, the ON-time of transistor 113 is set. Thus, the switching transistor 113 is turned ON/OFF based upon the above-described pulse signal so that the RF (radio frequency) current flows through the heating coil 107 in order to heat the metal pan 100.

The load detecting circuit 125 monitors whether or not the proper load is loaded on the heating coil 107. As illustrated in FIG. 4A, in case that the voltage "$V_I$" corresponding to the input current supplied from the AC power supply unit exceeds over the voltage "$V_{TON}$", a judgment is made that the proper load is loaded on the heating coil 107, whereby the heating operation is continued.

Conversely, when the voltage "$V_I$" is lower than the voltage "$V_{TON}$", another judgment is made that an improper load, e.g., no load or an aluminum pan, is loaded on the heating coil 107. In this case, as represented in FIG. 4B, there is a problem that it will take a time duration of, e.g., 300 milliseconds until such an improper loading condition is detected while the voltage $V_{TON}$ gradually increases and then the voltage $V_I$ becomes lower than the voltage $V_{TON}$.

In addition, as illustrated in FIG. 5A, when the input power to the DC/AC inverter 103 is high, the collector-to-emitter voltage of the switching transistor 113 employed in this inverter 103, namely the resonance voltage "$V_{CE}$" becomes a sinusoidal waveform during the turn-OFF period of this switching transistor 113, wherein the collector current "ic" of the switching transistor 113 is increased in a linear form within the ON-time period "$T_{ON}$" of the switching transistor 113. To the contrary, when the input power to the DC/AC inverter 103 is set low, as shown in FIG. 5B, the resonance voltage "$V_{CE}$" does not lower to zero volts and, thus, a predetermined potential is produced just before the switching transistor 113 is turned ON. This potential causes the transistor 113 to short circuit so that a short circuit current "Is" flows through the switching transistor 113. As a consequence, power loss in the switching transistor 113 becomes high.

As represented in FIG. 6A, according to a conventional electromagnetic cooling apparatus having such specifications that the input voltage is set to 100 V, and the input power is selected to be 1.2 KW at its maximum, when the input power is set to a low value, a the power loss "$W_{LOS}$" in the switching transistor 113 increases. Then, as the minimum input power, the input power can be reduced to approximately 300 watts. If this input power of 300 W is further lowered, the oscillating (switching) time period of the DC/AC inverter circuit 103 may be controlled in a second time period. For instance, the switching operation of the DC/AC inverter circuit 103 must be turned ON for 1 second, and turned OFF for 1 second.

There is a limitation in the maximum resonance voltage "$V_{CE}$" of the switching transistor 113 in the DC/AC inverter circuit of the conventional electromagnetic cooking apparatus having the input voltage of 200 V and the maximum input power of 2 KW, due to the rated voltage of this switching transistor. When, for instance, a bipolar type MOSFET, such as an IGBT (Insulated-Gage Bipolar Transistor), is employed as the switching transistor, and switched at a frequency of 25 KHz, the collector voltage thereof is limited to 1,000 volts or below under the normal operating condition since the maximum rated collector voltage of the switching transistor is about 1,400 volts. Furthermore, in the case of an input voltage of 200 V, the DC power source voltage applied from the DC power supply circuit is two times higher than that of the 100 V input voltage specification. Since the resonance voltage $V_{CE}$ is a voltage corresponding to a half time period of an attenuated waveform which is converged to the DC power source voltage, the resonance voltage "$V_{CE}$" of the 200 V input voltage specification is not so lowered as compared with that of the 100 V input voltage. Under the above-described circumstances, when the input power to the DC/AC inverter circuit is set to a lower value in case of the electromagnetic cooking apparatus having the 200 V input voltage specification, the practical minimum input power may not be selected to be lower than 1,000 watts, as illustrated in the graphic representation of FIG. 6B, because the switching transistor 113 may be destroyed due to an occurrence of such a short circuit current.

If, however, this input power of the 200 V input specification is further reduced to about 150 W, the oscillating time period of the DC/AC inverter circuit is controlled in such a manner that the operation of the inverter circuit is turned ON for, e.g., 17 seconds. In other words, the DC/AC inverter circuit 103 is operated only for 3 seconds, and the DC/AC inverting operation thereof must be interrupted for a longer time period, say 17 seconds, in order to achieve the above-described lower input voltage operation.

Such a blocking operation of the DC/AC inverter circuit has the following problems.

In the conventional electromagnetic cooking apparatus having the power source voltage of 100 V and the maximum input power of 1.2 KW, the operation of the DC/AC inverter circuit is turned ON/OFF at the ratio of 1:1 under the condition that the input power is controlled to set 300 W in the PWM (pulse width modulation) control mode. In other words, the inverting operation of the AD/AC inverter circuit is turned ON for 1 second and turned OFF for 1 second. Similarly, in case of the conventional electromagnetic cooking apparatus having the power source voltage of 200 V and the maximum input power of 2 KW, to realize the input power of 800 W, while the input power of the DC/AC inverter circuit is controlled in the PWM control mode to set 800 W, the inverting operation, namely the oscillation time period of the DC/AC inverter circuit is switched at the ratio of 8 to 2. That is, the inverting operation of the inverter circuit is turned ON for 4 seconds and subsequently turned OFF for 1 second. In accordance with the similar control method, to realize the inverter circuit is turned ON/OFF at the ratio of 3 to 17, namely turned ON for 3 seconds and thereafter turned OFF for 17 seconds. Such an ON/OFF control can be applied to either 100 V or 200 V of the power supply voltage in principle, as previously described.

However, to achieve such a lower input power of e.g., 150 watts in the conventional electromagnetic cooking apparatus, the oscillating period namely the switching operation of the DC/AC inverter circuit, must be turned ON/OFF for considerable lengths. As a result, the heating intervals between the succeeding heating operations become so long that the temperature of the article, such as food to be headed can hardly be maintained constant. Accordingly, there are temporal fluctuations in the temperature of the food, resulting in deterioration of the cooking capabilities by the electromagnetic cooking apparatus.

Under these circumstances an electromagnetic cooking apparatus capable of preventing this by quickly judging whether or not the proper load is loaded on the heating coil is needed. In the specific case that the input power to the DC/AC inverter circuit is set to a low value under the higher power supply voltage, there is another drawback that the switching element of the inverter circuit may break down unless the loading condition of the heating coil is quickly adjusted.

SUMMARY OF THE INVENTION

The present invention has been made in a attempt to solve the above-described problems of conventional electromagnetic cooking appartuses, and it is a primary object to provide an electromagnetic cooking apparatus where a quick judgment can be done in checking whether or not the proper load is loaded on the heating coil of the DC/AC inverter circuit, and also the fluctuations in the heating temperature can be avoided even when the input power to the DC/AC inverter circuit is set to a low value.

Furthermore, it is an object of the present invention is to provide an electromagnetic cooking apparatus capable of controlling the lower input power of the heating coil even under the higher power supply voltage, e.g., 200 V.

To achieve these objects an electromagnetic cooking apparatus according to the present invention comprises:

a DC (direct current) power supply circuit (201) for producing DC power from low-frequency AC (alternating current) power;

a DC-to-AC inverting circuit (203) coupled to the DC power supply circuit (201) and including a switching element (213) and also a heating coil (207), for inverting the DC power inputted from the DC power supply circuit (201) into high-frequency AC power so as to heat a metal pan (100) by energizing heating coil (207), thereby electromagnetically inducing eddy currents within the metal pan (100);

a monitoring circuit (227) for monitoring the DC power inputted into the DC/AC inverter circuit (203) so as to produce a DC input power signal;

a setting circuit (223) coupled to the DC /AC inverting circuit (203), for setting an ON-time duration of the switching element (213); and, a judging circuit (225) for judging whether or not the metal pan (100) to be heated corresponds to a heatable pan electromagnetically loaded on the heating coil (207) in response to the DC input power signal produced from the monitoring circuit (227) after a predetermined time duration has passed from a beginning of the ON-time duration, thereby controlling the inverting operation of the DC/AC inverting circuit (203).

Furthermore, to achieve another object of the present invention, an electromagnetic cooking apparatus (300:500) comprises:

a DC (direct current) power supply circuit (302:502) for producing DC power from low-frequency AC (alternating current) power;

a DC-to-AC inverting circuit (305) coupled to the DC power supply circuit (302:502) and including a switching element (309) and also a heating coil (306), for inverting the DC power inputted from the DC power supply circuit (302:502) into high-frequency AC power so as to heat a metal pan (100) by energizing the heating coil (306), thereby electromagnetically inducing eddy currents within the metal pan (100);

a monitoring circuit (312:314) for minitoring switching conditions of the switching element (309) so as to output a switching condition signal; and, an ON/OFF-controlling circuit (304:520) for turning ON/OFF either the DC power supply circuit (302), or DC/AC inverting circuit (305) in response to the switching condition signal at a timing period defined by a time constant smaller than a thermal time constant determined by a heat capacity of a material of the metal pan (100).

BRIEF DESCRIPTION OF THE DRAWINGS

For a better understanding of the present invention, reference is made to the following descriptions in conjunction with the accompanying drawings, in which:

FIGS. 11A-11G, 12A-12D and 13 illustrate detailed operations of the cooker 300 shown in FIG. 10;

DETAILED DESCRIPTION OF THE PREFERRED EMBODIMENTS

Basic Idea of Loading Condition Detection

First, in the electromagnetic cooking apparatus according to the present invention, for achieving the above-described primary object, a basic technical idea will now be summarized. It calls for the quick detection of the loading conditions of the heating coil.

In the electromagnetic cooking apparatus, when the switching means (DC/AC inverter) repeatedly performs the switching converting operation, the heating means connected to the switching means causes the eddy currents in the article (pan) to be heated by the magnetic flux generated when the switching means is turned OFF, whereby the article is heated. The electromagnetic cooking apparatus includes information output means for outputting the information related to the supplied power, and the ON-time setting means for setting the ON time of the switching means, and judging means for judging the loading condition during the ON time. That is to say, the judging means judges whether or not the article to be heated corresponds to the proper load, e.g., metal pan in response to the information related to the supplied power to the heating means after a predetermined time period has from the beginning of the ON time.

Overall Circuit Arrangement of First Electromagnetic Cooker

Figure 7:
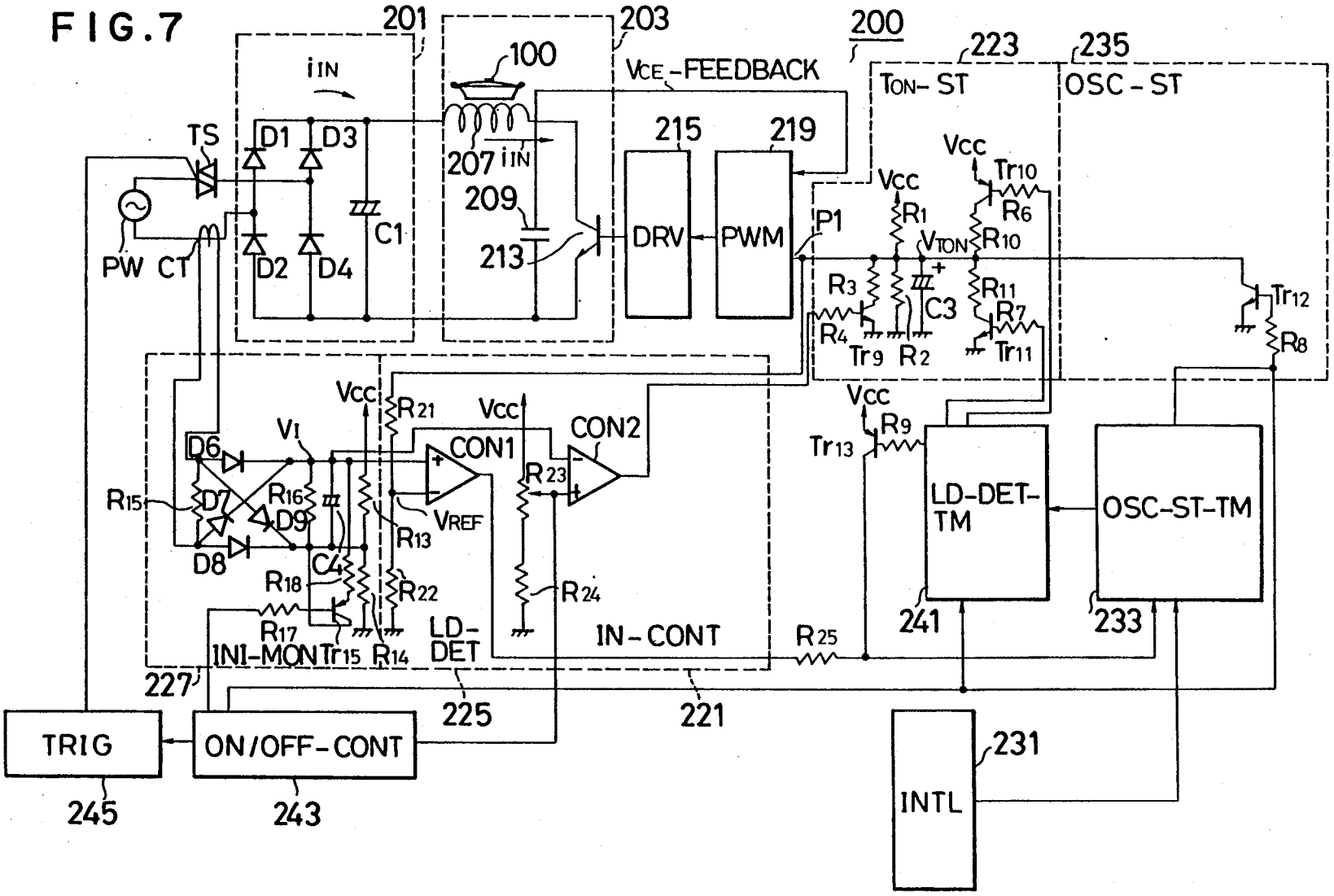
FIG. 7 is a schematic circuit diagram of an electromagnetic cooker 200 according to a first preferred embodiment, in which a loading condition detection is performed.

Referring now to FIG. 7, an overall circuit arrangement of an electromagnetic cooking apparatus 200 will be described into which the above-described basic idea to quickly detect the loading conditions of the heating coil has been applied. A power supply having a commercial frequency "PW" as the AC power supply is connected via a triac "TS" as a bi-directional three-terminal thyristor to a DC power supply circuit 201. The DC power supply circuit 201 is constructed of four diodes D1, D2, D3 and D4 which are connected in a bridge circuit, and a smoothing capacitor C1. The DC power supply circuit 201 converts the AC power supplied from the commercial-frequency power supply "PW" into the corresponding DC power. This DC power supply circuit 201 is connected to a DC-to-AC inverter circuit (simply referred to as a DC/AC inverter) 203 so as to supply predetermined DC power to the DC/AC inverter 203.

In the DC/AC inverter 203, a heating coil 207 is series-connected to a resonance capacitor 209, and also a switching transistor 213 is connected parallel to the resonance capacitor 209. The base electrode of this switching transistor 213 is connected to a driver circuit 215. In response to a drive signal supplied from the driving circuit 215, the transistor 213 is switched at a predetermined high frequency, e.g., 25 KHz so that both the heating coil 207 and resonance capacitor 209 are brought into the series resonance condition, and the magnetic flux generated in the heating coil 207 causes the eddy currents in the metal pan 100 by means OF the electromagnetic induction effects. As a consequence, an article to be heated such as food stored in the metal pan 100 is eventually heated to a predetermined desired temperature.

Figure 8A:
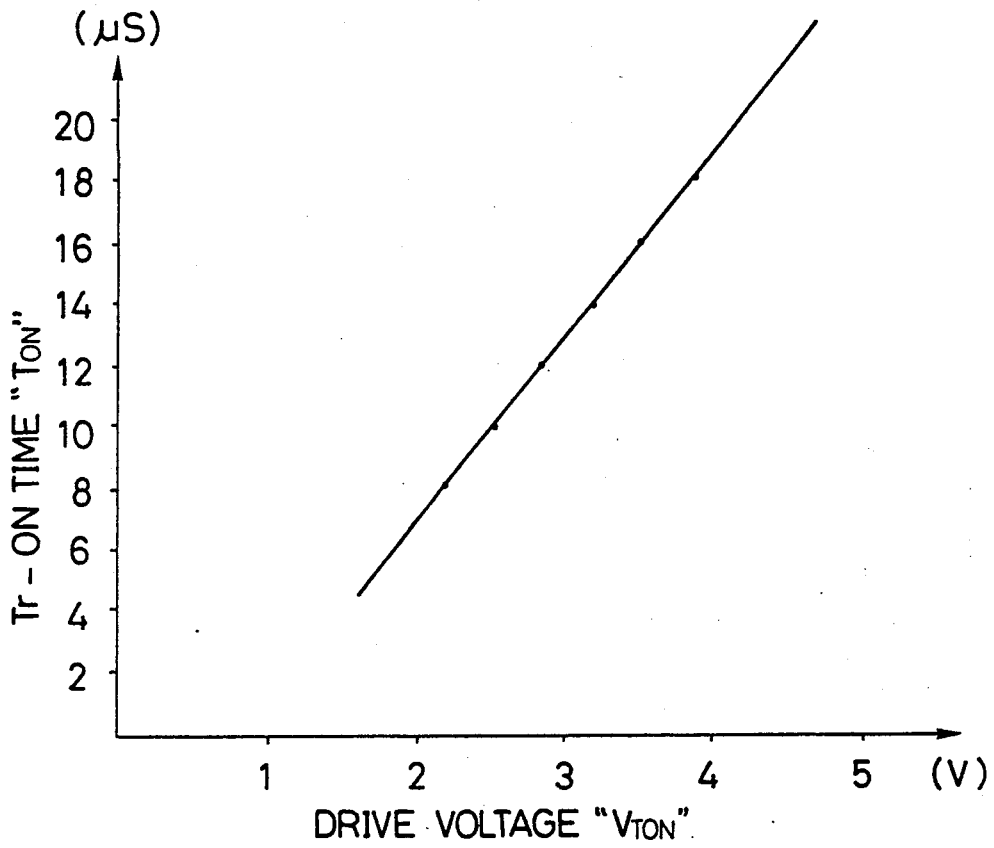
FIGS. 8A and 8B illustrate the loading condition detecting operations performed in the cooker 200 shown in FIG. 7.

A pulse width modulation (referred to as a "PWM") circuit 219 is connected to the driver circuit 215 and also to an ON-time setting circuit 223. When the voltage "$V_{TON}$" for setting the ON time is input from the ON-time setting circuit 23 to the PWM circuit 219, a pulse signal having a pulse width corresponding to the voltage "V TON" is output therefrom the driver circuit 215. Upon receipt of the pulse signal from the PWM circuit 219, the driver circuit 215 turns ON the switching transistor 213 of the DC/AC inverter 203 for a time duration corresponding to the pulse width of the pulse signal. As a result, as represented in FIG. 8A, the ON time $Y_{ON}$ of the transistor 213 is varied in response to the drive voltage "$V_{TON}$" applied from the ON-time setting circuit 223. In other words, when the drive voltage "$V_{TON}$" is changed, the pulse width of the pulse signal derived from the pulse width modulation circuit 219 is varied so that the ON time "$T_{ON}$" of the switching transistor 213 is changed. Thus, the output power of the switching transistor 213, i.e., the heating power by the DC/AC inverter circuit 203 is changed. In other words, the input power to the DC/AC inverter circuit 203 is controlled in response to the PWM-controlled drive pulse signal for the switching transistor 213. A junction between the heating coil 207 and resonance capacitor 209 is connected to a resonance voltage feedback terminal of the pulse width modulation circuit 219 in order that the resonance voltage "$V_{CE}$" appearing across the heating coil 207 and capacitor 209 is applied to the pulse width modulation circuit 219.

Internal Circuit of On-Time Setting Circuit

INTERNAL CIRCUIT OF ON-TIME SETTING CIRCUIT

An internal circuit of the ON-time setting circuit 223 will now be described.

Resistors R1 and R2 are series-connected to each other, a predetermined DC voltage "Vcc" is applied to one terminal of the resistor R1 and one terminal of the resistor R2 is grounded. A capacitor C3 is connected parallel to resistor R2. A junction between this resistors R1 and R2 is connected to an input terminal "P1" of the pulse width modulation circuit 219. This input terminal "P1" is connected via a resistor R3 to a collector of a transistor Tr9, and a base thereof is connected via a resistor R4 to an output terminal of a comparator CON2. Also the input terminal P1 of the ON-time setting circuit 223 is connected to a junction between resistors R10 and R11, the other terminal of the resistor R10 is connected to a collector of a transistor Tr10, and the other terminal of the resistor R11 is connected to a collector of a transistor Tr11. A base of the transistor Tr10 is connected to a load detecting timer 241 via a resistor R6, and a base of the transistor Tr11 is connected via a resistor R7 to the load detecting timer 241.

Figure 8B:
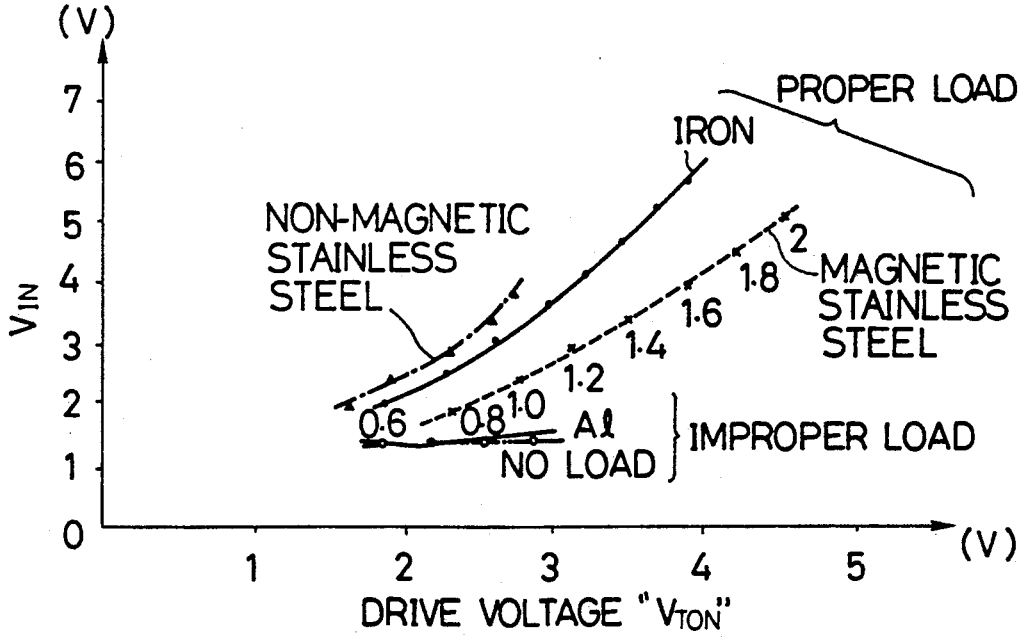

When the voltage $V_{TON}$ of the ON-time setting circuit 223 is set to a constant value, the ON time of the switching transistor 213 is also set to a constant time. Under these conditions, a judgement can be made whether or not the load such as the metal pan 100 corresponds to the proper load, i.e., electromagnetically heatable pan mounted on the heating coil 207 by monitoring the voltage "$V_I$" of the load detecting circuit 225 which corresponds to the input current "$i_{IN}$" flowing from the AC power supply "PW". As represented in FIG. 8B, when the voltage "$V_I$" of the load detecting circuit 225 exceeds over the voltage "$V_{TON}$" of the ON-time setting circuit 223, for instance, the proper load (e.g., an iron pan, or a magnetic stainless steel pan) is loaded on the heating coil 207. Conversely, when the former voltage "$V_I$" is lower than the latter voltage "$V_{TON}$", either no load is loaded, or an improper load (e.g., an aluminum pan, or a non-magnetic stainless steel pan) is loaded on the heating coil 207.

An oscillation stopping circuit 235 is arranged by a transistor Tr12 and a resistor R8. A collector of the transistor Tr12 is connected to the input terminal "P1" of the ON-time setting circuit 223, whereas a base of the transistor Tr12 is connected via a resistor R8 to an oscillation stopping timer 233, a load detecting timer 241 and an ON/OFF controlling 243, respectively. The oscillation stopping timer 233 is connected to an initializing circuit 231 and also to the load detecting timer 241.

The load detecting timer 241 is connected via a resistor R9 to a base of a transistor Tr13, an emitter of the transistor Tr13 is connected to a predetermined DC power supply, and a predetermined voltage "Vcc" is applied to an emitter of the transistor Tr13. A collector of this transistor Tr13 is connected to the oscillation stopping timer 233, and via a resistor R25 to an output terminal of a comparator "CON1".

Load-Condition Detecting Circuitry

A description will now be made to a load-condition detecting circuit 225 and peripheral circuitry thereof, namely an input controlling circuit 221 and an input current monitoring circuit 227. A current transformer "CT" is electromagnetically coupled to a power line connected between the AC power supply "PW" and DC voltage circuit 201 so as to output a detection signal having a value proportional to the input current supplied from the AC power supply "PW". A resistor R15 is connected parallel to the current transformer "CT". To this resistor R15, a bridge circuit constructed of four diodes D6, D7, D8 and D9 is connected. A resistor R16 is connected to this bridge circuit. A capacitor C4 is connected parallel to the resistor R16. A time constant determined by this resistor R16 and capacitor C4 is set to a time, e.g., a value longer than 10 msec which corresponds to a half cycle of the commercial-frequency power supply "PW". Both resistors R13 and R14 are series-connected between the ground line and the DC power supply outputting a predetermined voltage "Vcc", and a junction between these resistors R13 and R14 is connected to a cathode of the diode D8. A cathode of the diode D6 is connected to a non-inverting input terminal of the comparator "COV 1", and also via a resistor R18 to an emitter of a transistor Tr15. A collector of this transistor Tr15 is connected to a cathode of the diode D8, and also a base of the transistor Tr16 is connected via a resistor R17 to the ON/OFF controlling circuit 243.

In the load-condition detecting circuit 225, a resistor R21 is series-connected to a resistor R22, and a junction thereof is connected to an inverting input terminal of the comparator CON 1. This inverting input terminal of the comparator CON1 is connected via a resistor R21 to the input terminal P1 of the pulse width modulation circuit 219.

In the input controlling circuit 221, on the other hand, a variable resistor R23 and a resistor R24 are series-connected between a DC power source for applying a predetermined DC voltage "Vcc" and the ground line. A variable terminal of this variable resistor R23 is connected to a non-inverting input terminal of the comparator "CON 2". This non-inverting input terminal of the comparator CON2 is connected to the ON/OFF controlling circuit 243.

A triac trigger circuit 245 is connected to a gate electrode of the triac "TS", and also to the ON/OFF controlling circuit 243. In response to the signal supplied from the ON/OFF controlling circuit 243, the triac TS is switched. When the ON/OFF controlling circuit 243 judges that the low input power has been set by the variable resistor R23, it turns ON/OFF the triac TS via the triac trigger circuit 245. As a result, when the low input power is set by the variable resistor R23, the switching operation of the triac "TS" controls the DC/AC inverter circuit 203.

Proper Loading-Condition Detection

Referring now to waveform charts shown in FIG. 9, a load-condition detecting operation according for a first feature of the present invention will now be described.

Figures 9A, 9B, 9C, 9D, 9E, 9F:
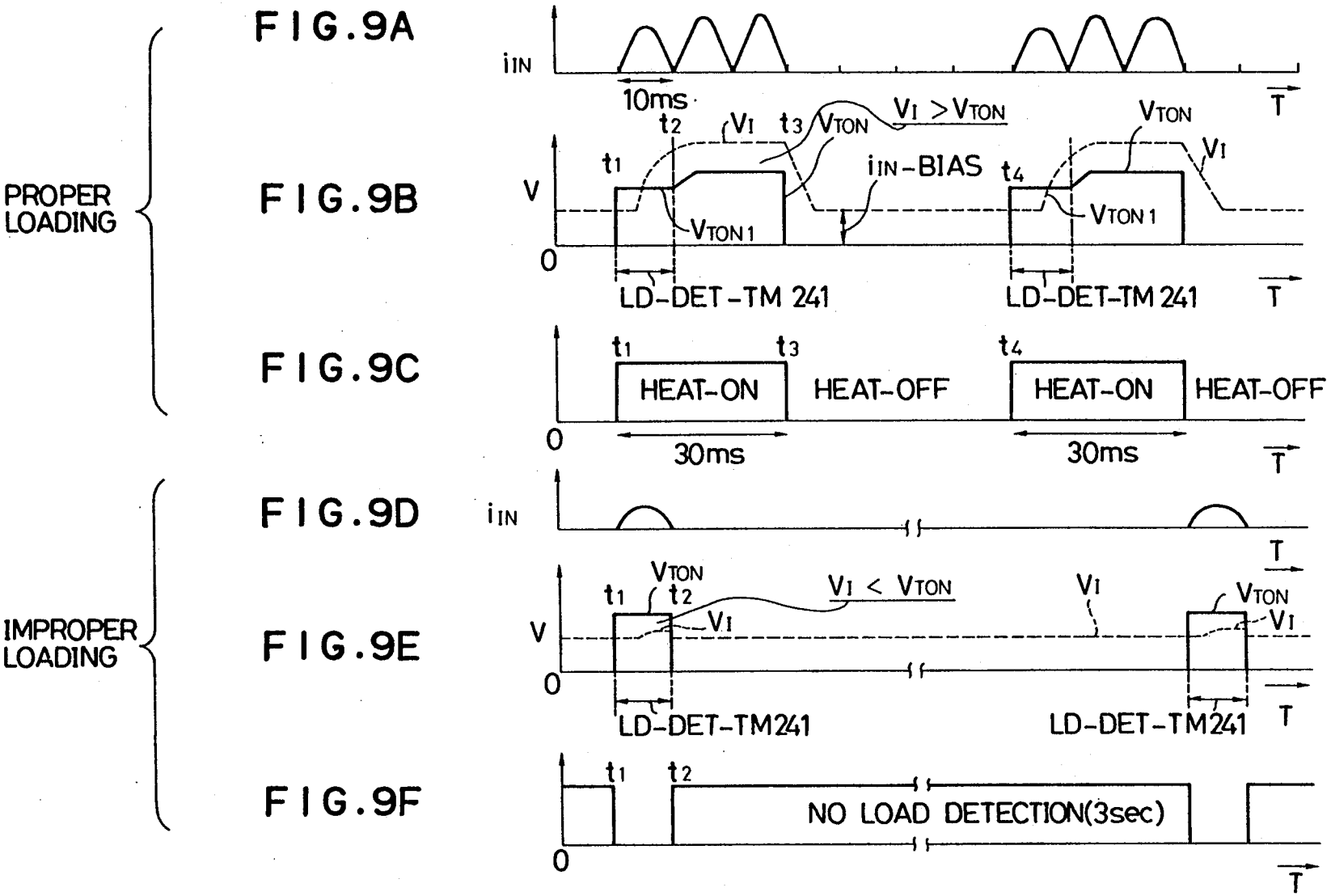
FIGS. 9A to 9F are waveform charts of the cooker 200 shown in FIG. 7.

First, a description is made to detecting a proper load, such as a metal pan loaded on the heating coil of the DC/AC inverter circuit, with reference to FIGS. 9A, 9B and 9C.

When the AC power supply "PW" of the electromagnetic cooking apparatus 200 is turned ON, the initializing circuit 231 is actuated to energize the oscillation stopping timer 233. The oscillation stopping timer 233 continues to turn ON the transistor Tr12 only for a predetermined time period, e.g., 3 seconds ("0" to "$t_1$" in FIG. 9B) so as to set the voltage "$V_{TON}$" to zero, so that the oscillating (switching) operation of the DC/AC inverter circuit 203 is stopped only for 3 seconds. After 3 seconds have passed (i.e., at a time instant "$t_1$"), the oscillation stopping timer 233 turns OFF the transistor Tr12 causing the transistor Tr12 to be turned OFF and simultaneously the load detecting timer 241 to be initialized.

From the time instant "$t_1$", the load detecting timer 241 turns OFF both the transistors Tr10, Tr11 and Tr13 for a time duration preset by the timer 241, for 10 milliseconds (i.e., "$t_1$" to "$t_2$"). When the transistors Tr10 and Tr11 are turned ON, a voltage ($V_{TON1}$) produced by subdividing the DC voltage Vcc by the resistors R10 and R11 is applied to the pulse width modulation circuit 2)9 as the voltage "$V_{TON}$" for setting the ON time. As a result, the switching transistor 213 is turned ON during the ON time corresponding to the pulse width of the PWM pulse signal furnished from the PWM circuit 219, whereby the DC/AC inverter circuit 203 performs the inverting operation. While the DC/AC inverting circuit 203 is operated, an input current "$i_{IN}$" flows through the DC power supply circuit 201 as illustrated in FIG. 9A.

The current transformer CT, on the other hand, detects this input current "$i_{IN}$" and outputs a detection current corresponding to this input current "$i_{IN}$". Then, after the detection current is rectified in another bridge circuit constituted by four diodes D6, D7, D8 and D9, the rectified detection current is smoothened in another smoothing circuit constructed of a resistor R16 and a capacitor C4. Since a time constant of this smoothing circuit is set longer than 10 msec (i.e., "$t_1$" to "$t_2$" in FIG. 9B), the detecting operation by the load detecting circuit 225 is prohibited. More specifically, as previously described, during the time duration of 10 msec defined from the time instant "$t_1$", to "$t_2$", the transistor Tr13 connected to the load detecting timer 241 becomes conductive in response to the signal derived from this timer 241, so that the output signal at the output terminal of the comparator CON1 is forcibly set to a high level. As a result, the energization of the oscillation stopping timer 233 is prohibited.

Figure 1:
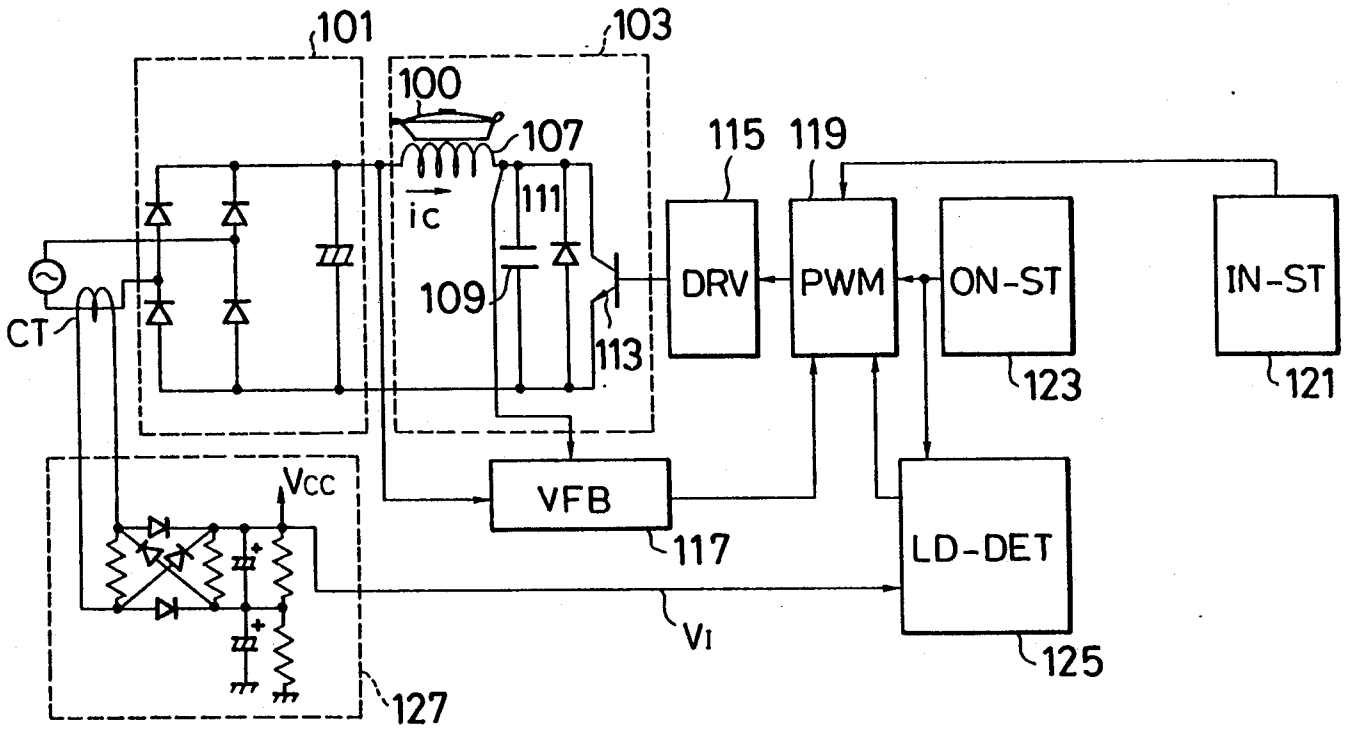
FIG. 1 PRIOR ART
FIGS. 1, 2A-2C, 3, 4A-4B, 5A-5B and 6A-6B illustrate a conventional electromagnetic cooking apparatus and operation thereof.
Figure 2A:
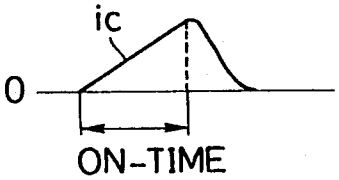
FIG. 2A PRIOR ART
Figure 2B:
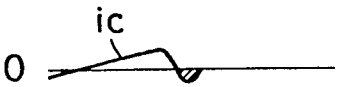
FIG. 2B PRIOR ART
Figure 2C:
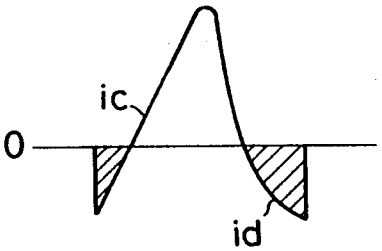
FIG. 2C PRIOR ART
Figure 3:
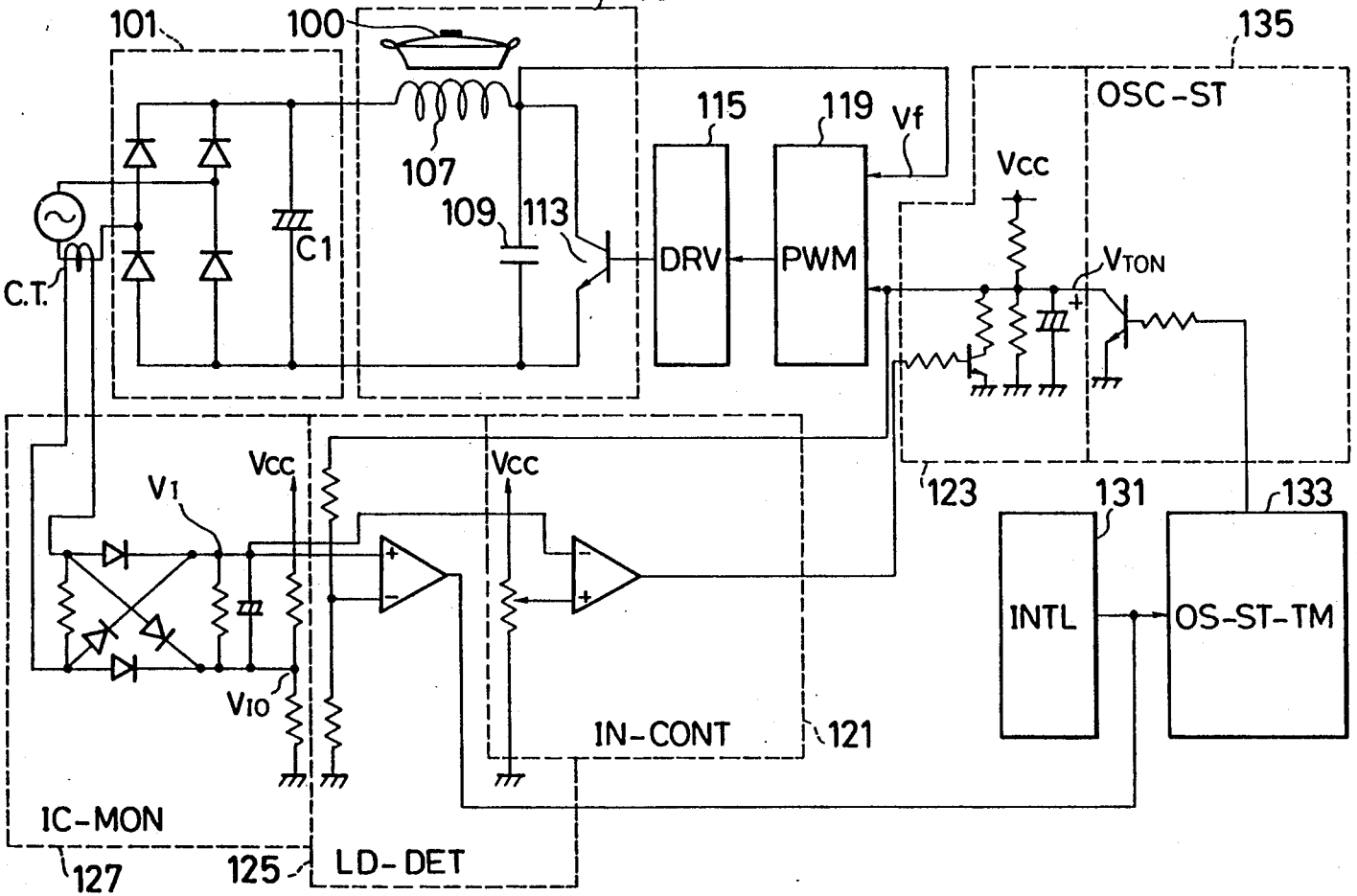
FIG. 3 PRIOR ART
Figure 4A:
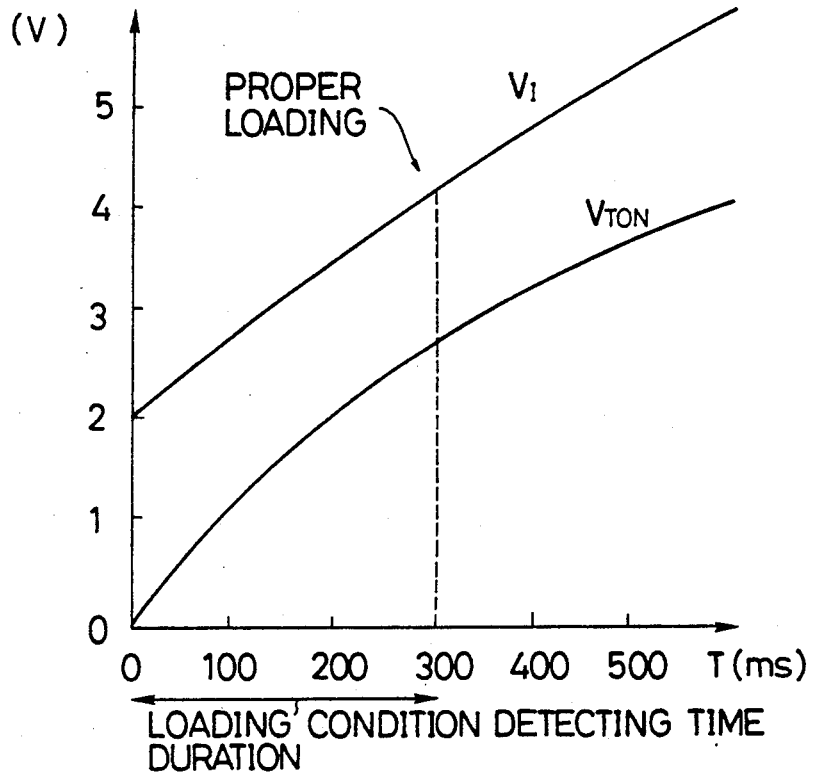
FIG.4A PRIOR ART

After the time instant "$t_2$" has passed, the voltage "$V_I$" corresponding to the input current "$i_{IN}$" is applied to the non-inverting terminal of the comparator CON1. In this comparator CON1, the above-described subdivided voltage obtained from the registors R21 and R22 is input as a reference voltage "$V_{REF}$" to the inverting terminal of the comparator CON1. The comparator CON1 judges whether or not the voltage "$V_{TON}$" from the On-time setting circuit 223 exceeds over the voltage "$V_I$" from the input current monitoring circuit 227 by comparing the, input voltage "$V_I$ with the reference voltage "$V_{REF}$". As represented in FIG. 9B, when the input voltage "$V_I$" exceeds over the voltage "$V_{TON}$", i.e., reference voltage "$V_{REF}$" (corresponding to FIG. 4A), the comparator CON1 judges that the prper load, i.e., heatable load is loaded on the heating coil 207 and continues the heating operation by the DC/AC inverter circuit 203. As shown in FIG. 9C, from the time instants "$t_1$" until "$t_3$", e.g., 30 msec, the triac TS connected to the DC power supply circuit 201 is turned ON, whereby the switching operation, or heating operation by the DC/AC inverter circuit 203 is carried out during 30 msec. From the subsequent time instants "$t_3$" to "$t_4$", e.g., 40 msec the triac TS is turned OFF, and also the transistor Tr12 of the oscillation stopping circuit 235 is turned ON in response to the signal output from the ON/OFF controlling circuit 243, whereby the switching (heating) operation of the DC/AC inverter circuit 203 is interrupted. Similarly, the ON/OFF operations of the triac TS are repeatedly continued. That is to say, in accordance with the electromagnetic cooking apparatus 200 of the preferred embodiment, while the quick loading condition detection is carried out, the lower input power control to the DC/AC inverter circuit 203 is simultaneously performed by ON/OFF-controlling the DC control circuit 302.

It should be noted that while the heating operation by the DC/AC inverter circuit 208 is interrupted, the transistor Tr15 is turned ON in response to the signal derived from the On/OFF controlling circuit 243, whereby the charges in the capacitor C4 of the input current monitoring circuit 227 is discharged so as to be set to the initial condition.

Improper Loading-Condition Detection

Referring to FIGS. 9D, 9E, and 9F, the no load condition detecting operation will now be described.

Figure 4B:
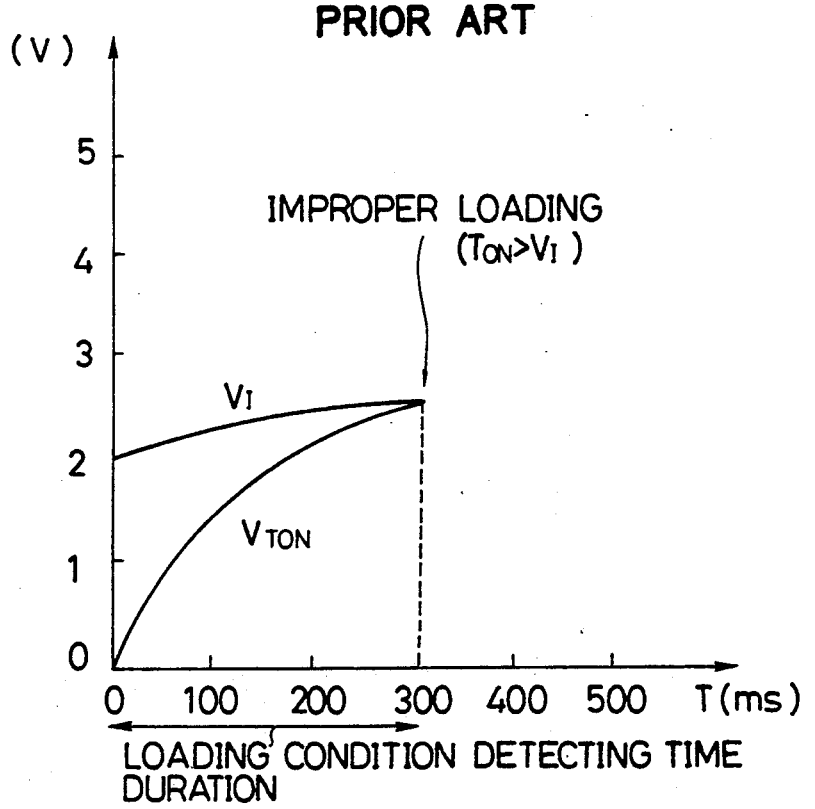
FIG.4B PRIOR ART
Figure 5A:
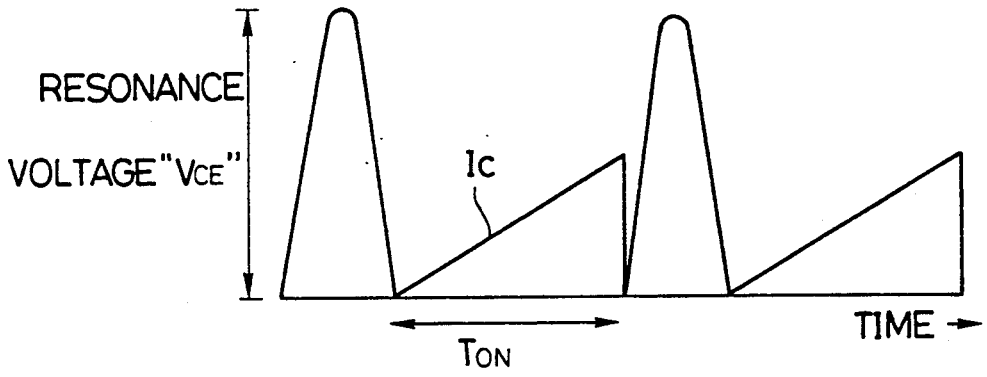
FIG.5A PRIOR ART
Figure 5B:
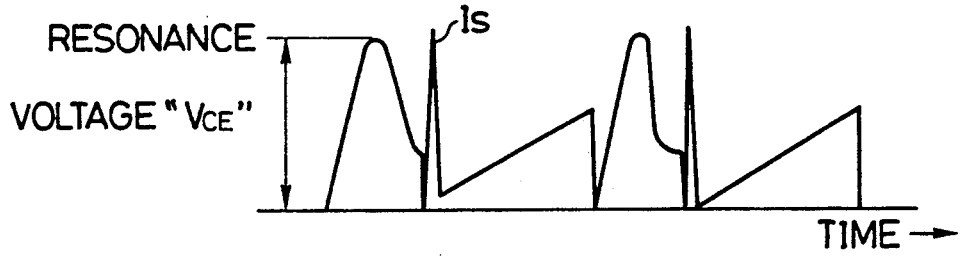
FIG.5B PRIOR ART
Figure 6A:
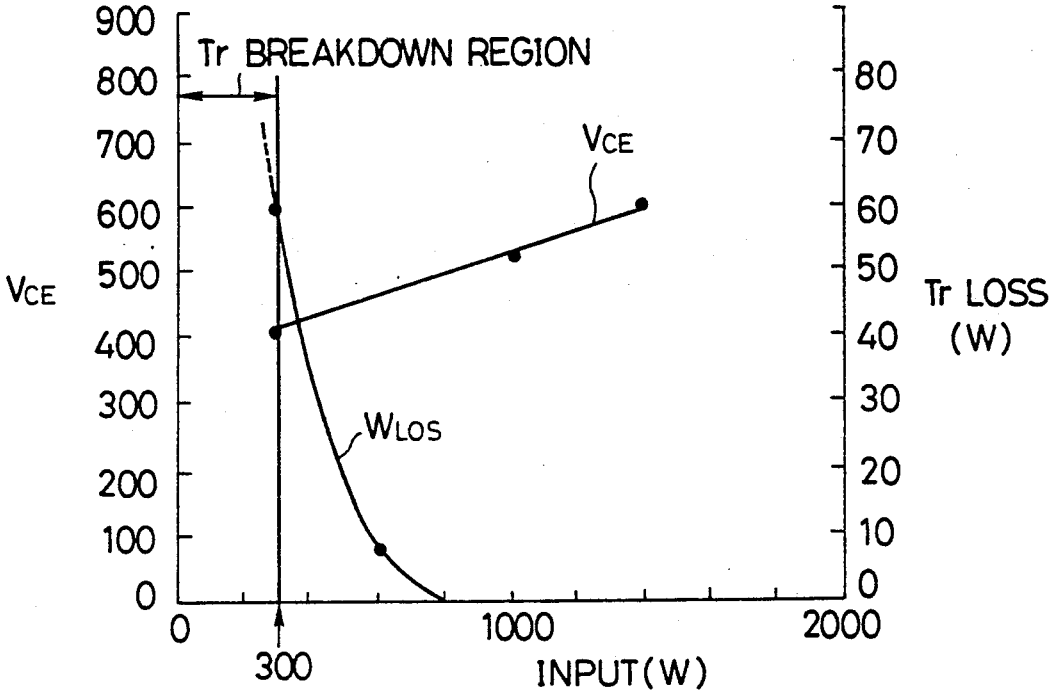
FIG.6A PRIOR ART
Figure 6B:
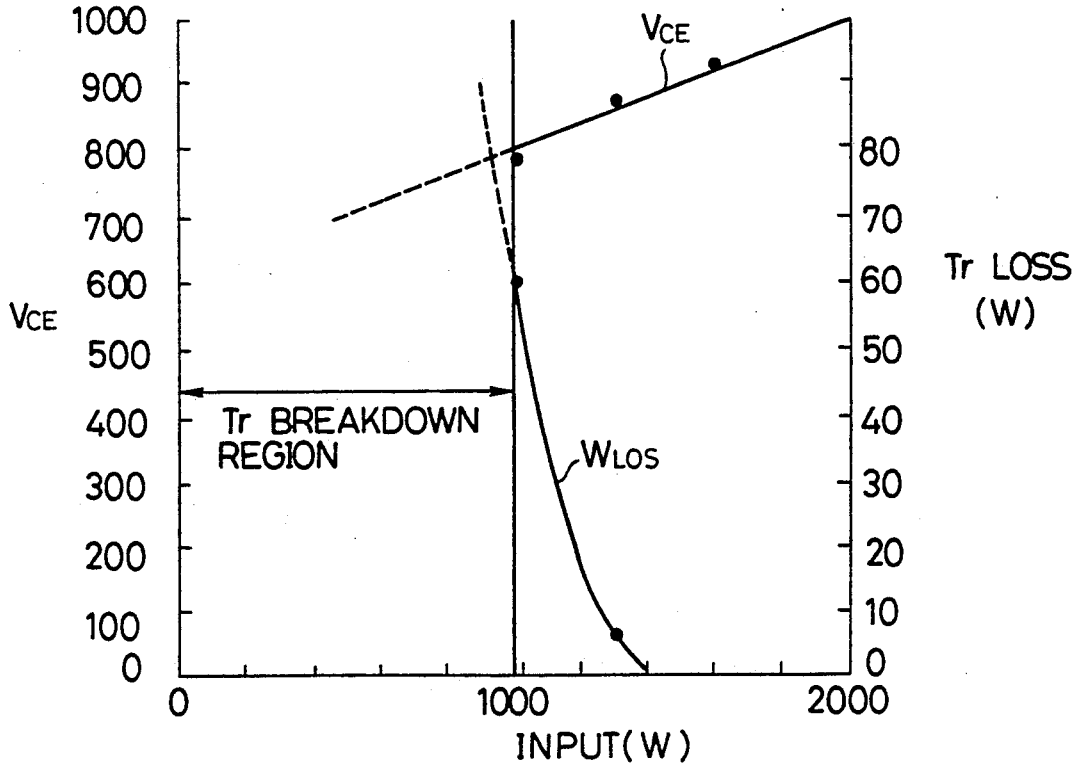
FIG.6B PRIOR ART

Similar to the previous detecting operation, the detecting operation by the load detecting circuit 225 is prohibited for a time duration from the time instants "$t_1$" to "$t_2$". After the time instant "$t_2$" has passed, the comparator CON1 compares the input voltage "$V_I$" with the reference voltage "$V_{REF}$" in order to judge whether or not the input voltage "$V_I$" is below the ON-time setting voltage "$V_{TON}$". If the input voltage "$V_I$" is lower than the ON-time setting voltage "$V_{TON}$" (corresponding to FIG. 4B), a judgement is made that no metal pan 100 is loaded on the heating coil 207, that is to say, no load condition. As a consequence, the comparator CON1 outputs the low-leveled signal to the oscillation stopping timer 233. In response to the signal from the oscillation stopping timer 233, the heating (switching) operation by the DC/AC inverter circuit 203 is interrupted for 3 seconds.

Subsequently, just after a predetermined time duration (the time "0" to "$t_1$", e.g., 3 seconds) has passed which is determined by the load detecting timer 241, another judgement is made to the load condition by checking the input voltage "$V_I$".

As a consequence, the quick loading-condition detection can be accomplished in the no load condition. Furthermore, when the input DC power to the DC/AC inverter circuit 203 is lowered, the triac TS is turned ON/OFF at the low-frequency repetition cycle so that the heating operation of the DC/AC inverter circuit 203 is controlled in the blocking form. Since the oscillation period of the inverter circuit 203 can be set to be shorter than that of the conventional inverter circuit 103, the fluctuations in the heating temperature of the metal pan 100 can be avoided. As a result, an article to be heated, e.g., food in the pan 100, can be heated at relatively lower temperature, e.g., 150 W input power.

It should be noted that in the first preferred embodiment shown in FIG. 7, the triac was connected between the AC power supply and bridge rectifier circuit. Alternatively, another simpler circuit arrangement capable of properly controlling the oscillation of the DC/AC inverter circuit may be employed as these circuits.

The triac may be substituted by other switching elements such as a thyristor.

A microcomputer may be employed so as to perform all of the above-described functions, i.e., the loading-condition detection, ON-time setting operation, input controlling, and ON/OFF controlling.

While described above, in the electromagnetic cooking apparatus 200 according to the first preferred embodiment, the judgement whether or not an article to be heated corresponds to a heatable article, i.e., proper load mounted on the heating coil of the DC/AC inverter circuit, is carried out based upon the information on the power inputted to the inverter circuit, that is, the input power detected after a predetermined time period has passed from the beginning of the ON-time of the inverter circuit. As a consequence, the quick detection can be performed whether or not the proper load is loaded on the heating coil.

Basic Idea of Low Input Power Control

To attain the secondary object of the present invention, the basic idea on the lower input power control effected in the electromagnetic cooking apparatus is as follows.

While the electromagnetic cooking apparatus is operated under the lower input power to the DC/AC inverter circuit, or at the lower heating temperature, either the rectifier circuit or the DC/AC inverter circuit thereof is turned ON/OFF at a timing period defined by a time constant smaller than a thermal time constant of a material of an article to be heated, such as a metal pan. For instance, the switching (inverting) operation of the DC/AC inverter circuit is carried out at the relatively higher timing period, e.g., 25 KHz, whereas the ON/OFF operation of either the rectifier circuit or DC/AC inverter circuit is performed at the relatively lower timing period, e.g., 50 Hz.

As a result of such an ON/OFF control, the fluctuations in the heating temperature under the lower input power can be prevented, whereby a lower constant temperature control can be achieved in the electromagnetic cooking apparatus.

Overall Circuit Arrangement of Electromagnetic Cooker With Low Power Control

Figure 10:
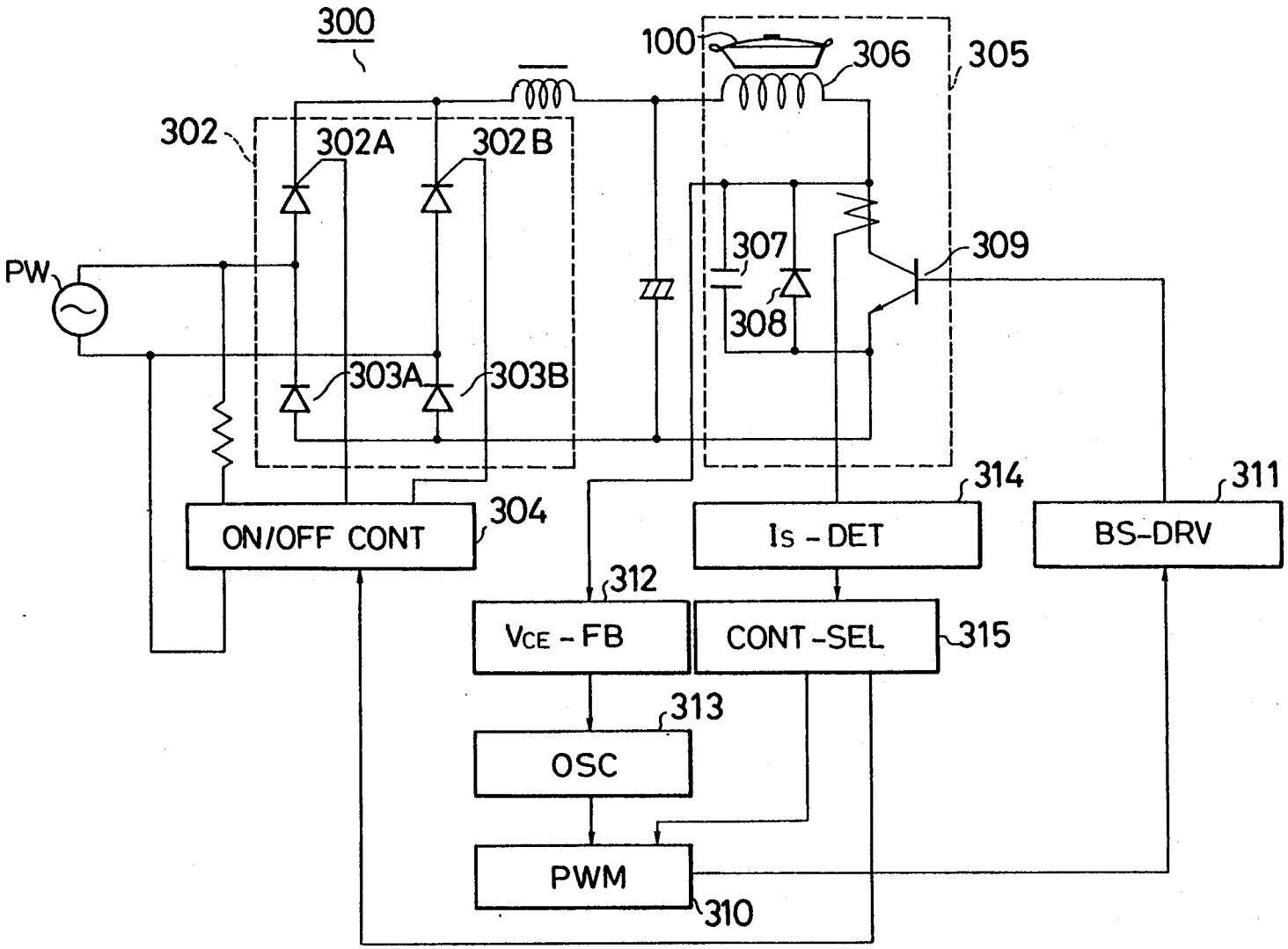
FIG. 10 is a schematic circuit diagram of an electromagnetic cooker 300 according to a second preferred embodiment, in which a low power control is carried out.

Referring now to FIG. 10, an overall circuit arrangement of an electromagnetic cooking apparatus 300 according to a second preferred embodiment of the invention will be described.

It should be noted that the cooking apparatus 300 according to the second preferred embodiment employs the first basic idea of the invention. That is, the rectifier circuit is turned ON/OFF at the relatively lower timing period so as to obtain the lower input power to the DC/AC inverter circuit.

In the circuit arrangement shown in FIG. 10, a commercial-frequency power supply "PW" is connected to a rectifier circuit 302. The rectifier circuit 302 is constructed of two thyristors 302A and 302B, and two diodes 303A and 302B, and two diodes 303A and 303B connected to form a bridge circuit. Each of these thyristors is connected to an ON/OFF controlling circuit 304.

The ON/OFF controlling circuit 304 performs the zerocross switching control for switching the current flowing through the rectifier circuit 302 in response to an ON/OFF control signal. A plus terminal of the rectifier circuit 302 is connected to a DC/AC inverter circuit 305. The DC/AC inverter circuit 305 is arranged by a heating coil 306, a resonance capacitor 307 forming a series resonance circuit together with the heating coil 306, a flywheel diode 308, and a switching transistor 309. A base current to the switching transistor 309 is driven via a base drive circuit 311 in response to a PWM (pulse width modulation)-controlled signal derived from a pulse width modulation circuit 310, so that both the heating coil 306 and resonance capacitor 307 are brought into a series resonance condition. As a result, a large resonance current flows through the heating coil 306. As a result, due to the electromagnetic induction effects caused by the magnetic field produced from the heating coil 306, eddy currents are induced in an article to be heated, namely a metal pan 100, whereby the metal pan 100 is heated and eventually food (not shown in detail) in the metal pan 100 is heated to a desired heating temperature.

A junction between the heating coil 306 and the switching transistor 309 is connected to a voltage feedback circuit 312, and this voltage feedback circuit 312 is connected to an oscillator circuit 313. The functions of the voltage feedback circuit 312 are to monitor the series resonance phenomenon by the heating coil 306 and resonance capacitor 307, to detect the resonance voltage "$V_{CE}$" across the heating coil 306, namely the timing of the portion of the sinusoidal waveform "$V_{CE}$ (i.e., collector-to-emitter voltage of switching transistor 309), and also to feedback the detected resonance voltage "$V_{CE}$" to the oscillator circuit 313 thereby efficiently driving the heating coil 306.

The oscillator circuit 313 produces the resonance frequency. Based upon this resonance frequency, the pulse-width modulated control by the PWM circuit 310 is performed.

A short circuit current detecting circuit 314 detects a short circuit flowing through the collector of the switching transistor 309. A control circuit selecting circuit 315 changes the PWM circuit 310 by the ON/-

OFF controlling circuit 304 as an input power control circuit for the DC/AC inverter circuit 305 when the collector current of the switching transistor 309 exceeds over a predetermined value in response to a detection signal from the short circuit detecting circuit 314.

On/Off Controlling of Rectifier Circuit

The ON/OFF controlling operation by the electromagnetic cooking apparatus 300 according to the second preferred embodiment now be described with reference to FIGS. 10 to 12.

FIG. 11 is a waveform chart of switching operations of the DC/AC inverter circuit 305 shown in FIG. 10, and FIG. 12 is also a waveform chart for explaining the short circuit of the switching transistor 309.

When the DC input power to the DC/AC inverter circuit 305, i.e., the heating coil 306 is large (i.e., the higher input power), as represented in FIG. 11D, a PWM-controlled pulse signal having a longer time period "$T_{ON}$" is supplied via the base drive circuit 311 to the base of the switching transistor 309 so as to control the DC input power to the heating coil 306. In this case, since the transistor 309 is simultaneously turned ON when the resonance voltage "$V_{CE}$" becomes zero volt (see FIGS. 11B and 11C), no back electromotive voltage is produced. As a result, no short circuit current flows through the switching transistor 309. Under this condition, the collector current IC of the switching transistor 309 is represented in the left portion of FIG. 12A, and the ON/OFF controlling circuit 304 continues to turn On both the thyristors 302A and 302B of the rectifier circuit 302.

To the contrary, when another PWM-controlled pulse signal having a short timer period "$T_{ON}$" (see FIG. 11G) is supplied from the PWM circuit 310 to the base of the switching transistor 309 so as to set the lower DC input power, the back electromotive voltage becomes large as the time period "$T_{ON}$" is shortened. This back electromotive voltage causes the short circuit "$I_S$" (see FIG. 11F) in the switching transistor 309 at a time instant when the switching transistor 309 is turned ON. As a result, the short circuit current "$I_S$" causes a loss in the switching transistor.

Figure 13:
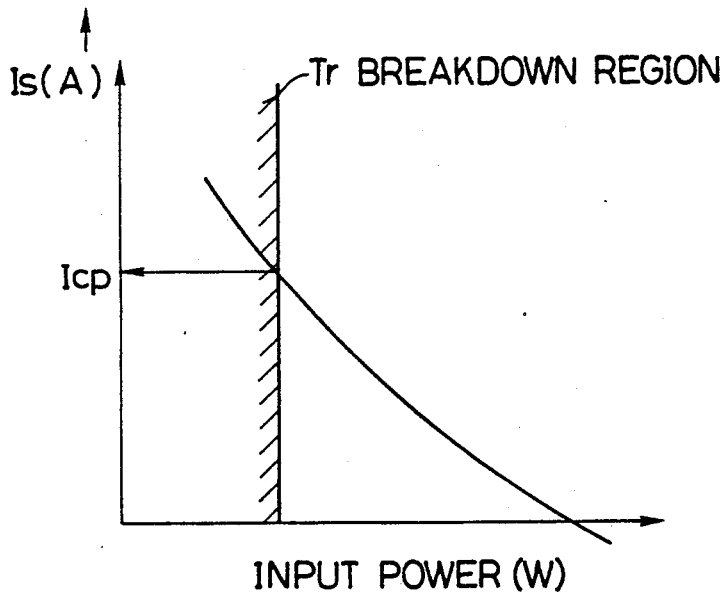

FIG. 13 represents a relationship between such a short circuit current "$I_S$" and DC input power. In FIG. 13, if the input power is reduced and the resultant short circuit current "$I_S$" exceeds over "$I_{CP}$", switching transistor 309 break down. As a consequence, such a transistor breakdown can be avoided by monitoring the short circuit current "$I_S$" and controlling this current.

Figures 12A, 12B, 12C, 12D:
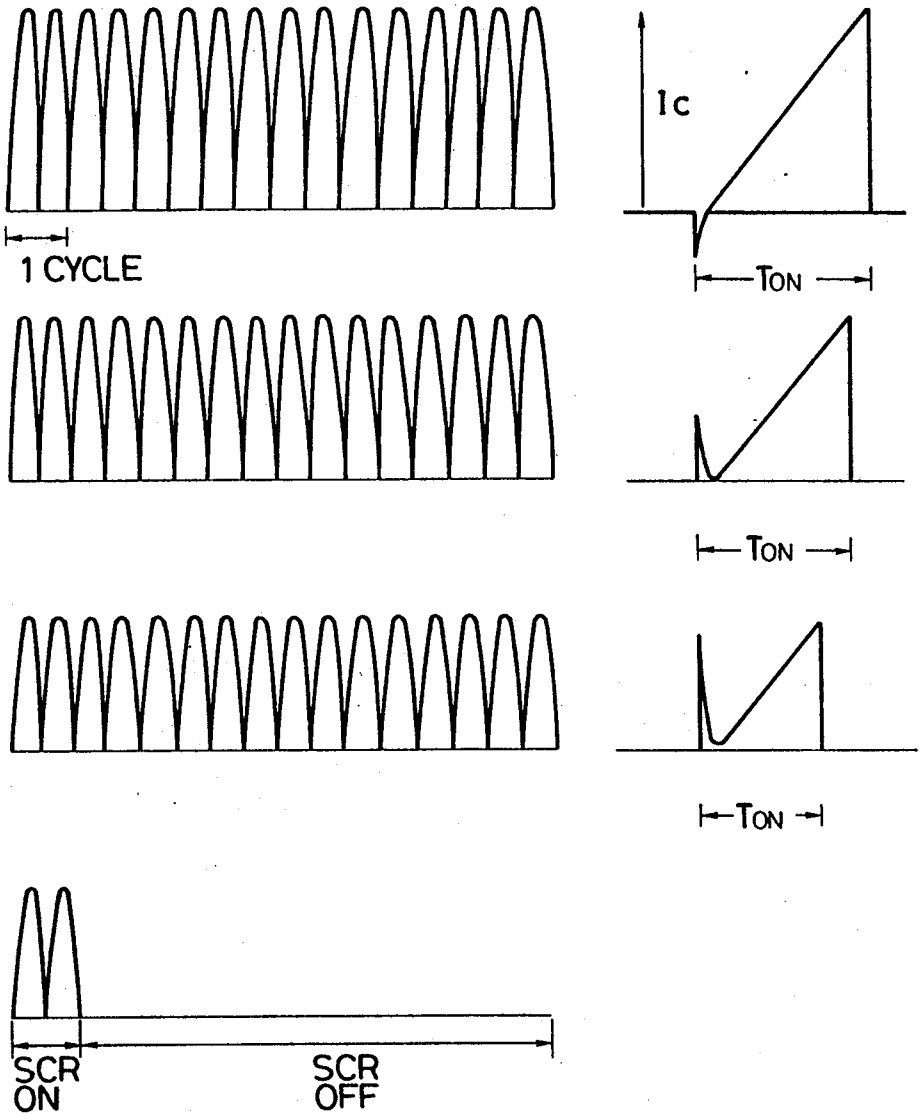

When the high input power is reduced to the low input power to the DC/AC inverter circuit, the detecting value of the short circuit current detecting circuit 314 for monitoring the short circuit current "$I_S$" is increased with an increase in the short circuit current "$I_S$". When the short circuit current of the switching transistor 309 becomes substantially the current value of the breakdown region, the control circuit selecting circuit 315 outputs a control circuit changing signal to the ON/OFF controlling circuit 304 while the PWM-controlled pulse having a predetermined time period "$T_{ON}$" is derived from the PWM circuit 310 with maintaining the minimum low input power available only under the PWM control. In response to this changing signal, the ON/OFF controlling circuit 304 performs ON/OFF switching control in the zerocross switching mode in such a way that as a unit of ½ cycle of a commercial-frequency (for instance, 10 msec in case of 50 Hz commercial frequency), as illustrated in FIG. 12D, the thyristors 302A, 302B are turned ON for a predetermined unit, and subsequently turned OFF for another preselected unit, and repeated similarly. In general, under such a control method, when the maximum input power is selected to be 2 KW at 200 V of AC power source voltage, the minimum input power controllable only in the PWM controlling mode is approximately 1 KW. In FIG. 12C, there is shown a collector current "$I_C$" of the switching transistor 309 in case of the DC input power of 1 KW. At this time, to realize the low input power of 150 W, when the switching transistor 309 is turned On for two units if 16 units are determined as 1 block (i.e., 8 time periods of the commercial frequency), then the resultant input power is equal to $(2/16)\times 1000=125$ W. As a consequence, the lower input power required to maintain a constant lower temperature can be realized without fluctuations in the cooking temperatures with respect to a time lapse.

Third Electromagnetic Cooker

Figure 14:
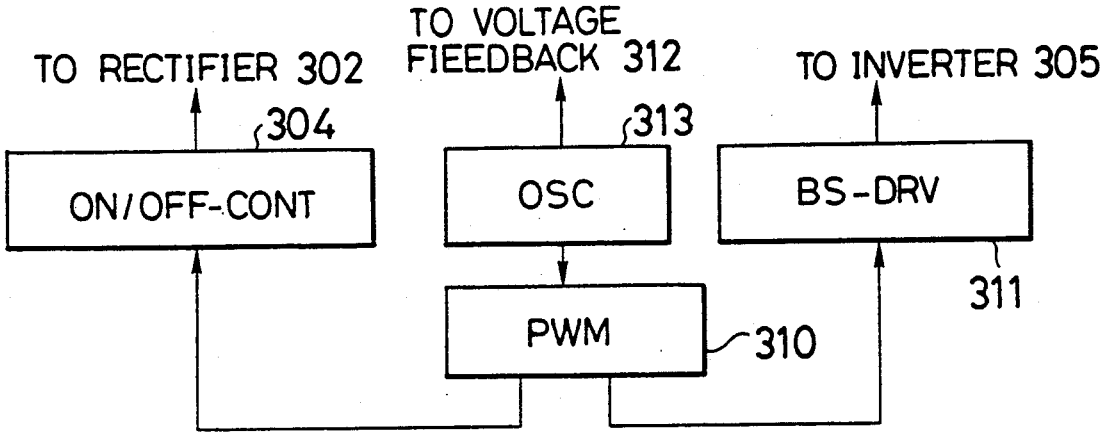
FIG. 14 is a schematic block diagram of a cooker according to a third preferred embodiment.

Referring now to FIG. 14, an electromagnetic cooking apparatus according to a third preferred embodiment, where the rectifier circuit 302 is turned ON/OFF at the lower frequency, will be described.

Since the major circuit arrangement of this third electromagnetic cooker is substantially same as that of the second electromagnetic cooker, different circuit arrangements will be described.

In the third preferred embodiment, there is a particular advantage that neither the short circuit detecting circuit 314, nor the control circuit selecting circuit 315 is employed. In FIG. 14, the PWM circuit 310 for performing PWM control in response to the resonance frequency derived from the oscillator circuit 313, actuates the ON/OFF control circuit 304 when the DC input power becomes low and the pulse width reaches a predetered width "$T_{ON}$".

Fourth Electromagnetic Cooker

An electromagnetic cooker according to a fourth preferred embodiment will now be summarized.

Figure 15:
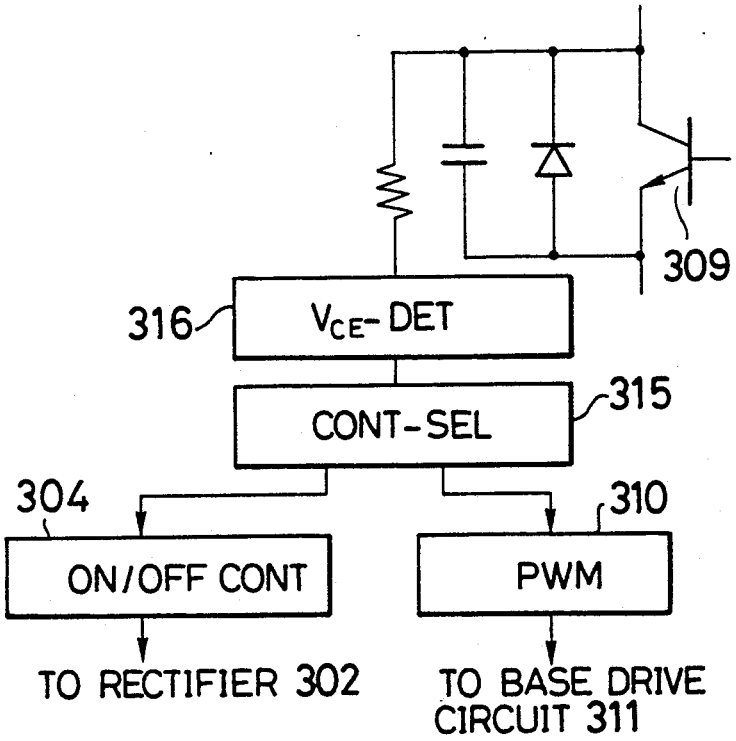
FIG. 15 is a schematic block diagram of a cooker according to a fourth preferred embodiment.

A particular feature of this third electromagnetic cooker is such that a $V_{CE}$ detecting circuit 316 is newly employed so as to detect the collector-to-emitter voltage of the switching transistor 309 in the DC/AC inverter circuit without employing the short circuit current detecting circuit 314 in the second preferred embodiment. In FIG. 15, the collector-to-emitter voltage of the switching transistor detected by the $V_{CE}$ detecting circuit 316 is output to the control circuit changing circuit 315, and this control circuit changing circuit 315 changes the PWM circuit 310 into the ON/OFF controlling circuit 304 when this detected voltage drops below a predetermined value.

Fifth Electromagnetic Cooker

Figure 16:
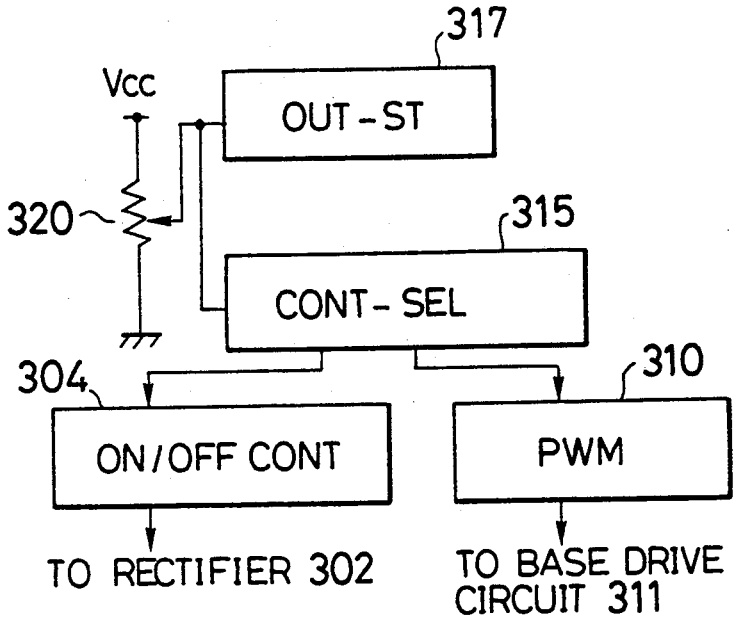
FIG. 16 is a schematic block diagram of a cooker according to a fifth preferred embodiment.

FIG. 16 shows an electromagnetic cooker according to a fifth preferred embodiment, in which a variable resistor 320 for setting output power is employed to form an output setting unit 317 for presetting a predetermined value, instead of the short circuit current detecting circuit 314 in the second preferred embodiment. In FIG. 16, in accordance with a predetermined value preset by the output setting unit 317, the control circuit selecting circuit 315 selects the ON/OFF controlling circuit 304 as the PWM circuit 310 to control the rectifier circuit at the lower input power.

Sixth Electromagnetic Cooker

An electromagnetic cooker 400 according to a sixth preferred embodiment will now be described.

Figure 17:
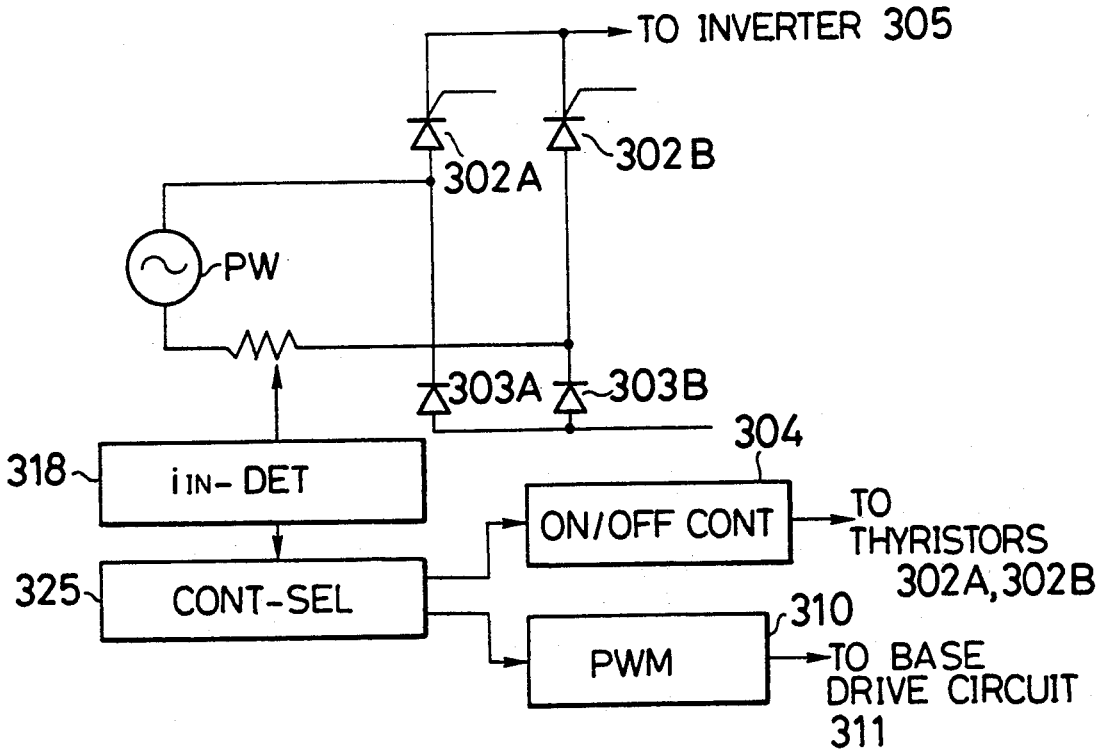
FIG. 17 is a schematic block diagram of a cooker 400 according to a sixth preferred embodiment.

In FIG. 17, there is shown the sixth electromagnetic cooker 400 where an input current detecting circuit 318 for detecting an input current to the rectifier circuit 302 is newly employed, instead of the short circuit current detecting circuit 314 of the second electromagnetic cooker. In the sixth electromagnetic cooker 400, the control circuit selecting circuit 315 changes the PWM circuit 310 into the ON/OFF controlling circuit 304 when the input current detected by the input current detecting circuit 318 for monitoring the input current to the rectifier circuit 302 reaches a predetermined value.

Internal Circuit of Input Current Detector

Figure 18:
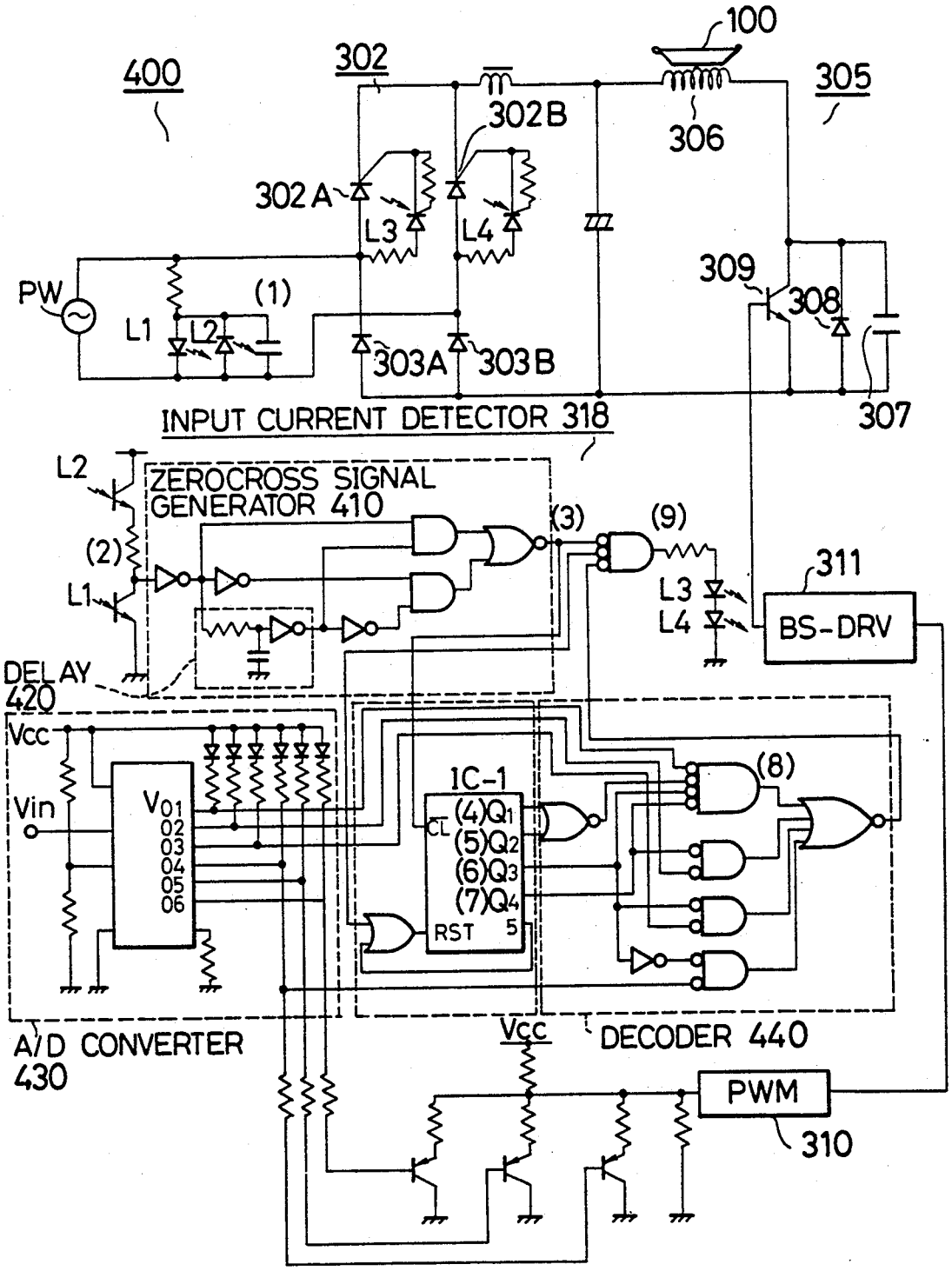
FIG. 18 is a circuit diagram of an internal circuit of the input current detector 318 shown in FIG. 17.

In FIG. 18, there is shown an internal circuit of the input current detecting circuit 318 illustrated in FIG. 17. FIGS. 19A–19I represents operation waveforms of this detecting circuit.

It should be noted that signals indicated by reference numerals letters A to I in the waveform chart of FIG. 19 appear in the circuit portions of the detecting circuit 318.

Figure 19A:
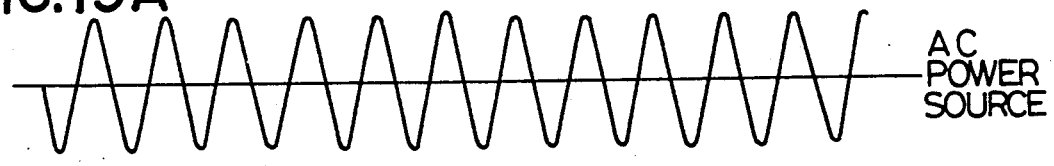
FIGS. 19A-19I are waveform charts of signals appearing in the cooker shown in FIG. 18.
Figure 19B:
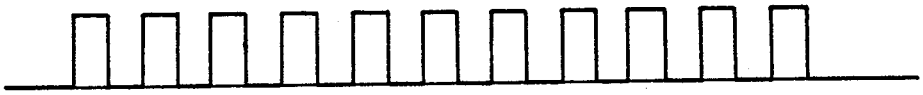
Figure 19C:
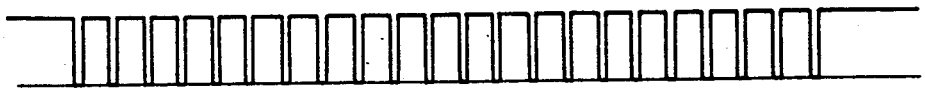
Figure 19D:
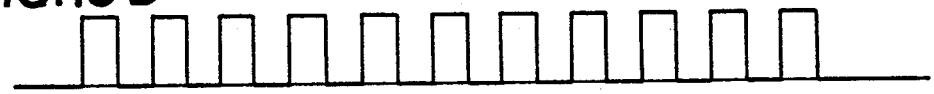
Figure 19E:
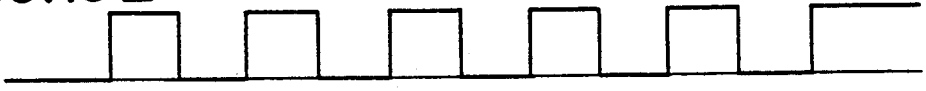
Figure 19F:
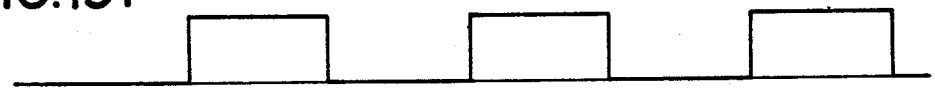
Figure 19G:
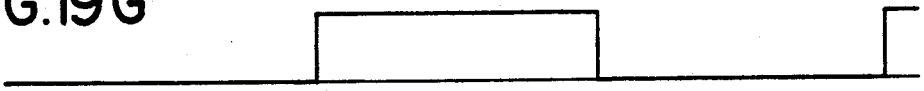
Figure 19H:
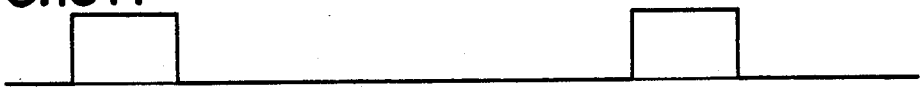
Figure 19I:
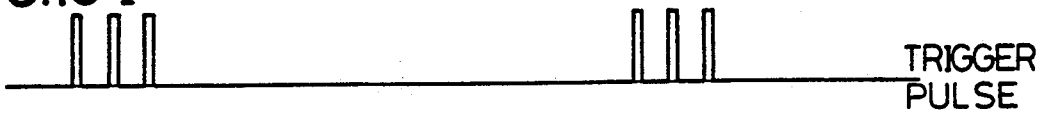

A sinusoidal wave (see FIG. 19A) whose frequency is proportional to the commercial frequency is processed by photocouplers "$L_1$" and "$L_2$" to produce a pulse signal as represented in FIG. 19B. A zerocross signal generating unit 410 AND-gates this pulse signal and another pulse signal which has passed through a delay circuit 420, thereby producing a pulse signal shown in FIG. 19C which falls at the respective zerocross points with having a frequency proportional to the commercial frequency. In a 4-bit binary counter IC-1, the last-mentioned pulse signal is used as a clock pulse to count up the count value, and pulse signals are produced at respective terminals Q1 to Q4 (see FIG. 19D to 19G). In response to a Vin level of an A/D converter 430 into which either a signal proportional to the short circuit current, or a setting value is input, when only the output voltage of $V_{01}$ of the A/D converter 430 becomes a "L" level, a pulse signal (see FIG. 19H) generated from logic gates ($Q_1$ OR $Q_2$) AND $Q_3$ and AND $Q_4$ is produced from a decoder 440, a signal shown in FIG. 19I which becomes a "H" level at the zerocross time is output, so that the thyristors 302A and 302B are turned ON at the zerocross timing for operating the rectifier circuit 302. The ON timer periods of these thyristors are selected to be 3/16 so that the input full power to this rectifier circuit 302 can be reduced to 3/16.

Consequently, according to the sixth electromagnetic cooker 400, since the rectifier circuit 302, i.e., thyristors 302A and 302B are controlled at a ½ time period of the commercial frequency, e.g., at 10 msec of 50 Hz, the breakdown of the switching transistor 309 can be avoided, the lower heating power can be achieved without fluctuations in the heating temperature of food in the metal pan 100. That is, the cooking capabilities of the fifth electromagnetic cooker 400 can be improved. Moreover, since the electromagnetic cooker can be operated under the commercial-frequency power supply of 200 V and the input power of 2 KW the cooking or heating output power can be set higher than in the cooker operated under the commercial-frequency power supply of 100 V and the input power of 1.2 KW, so power can be realized.

Figure 20:
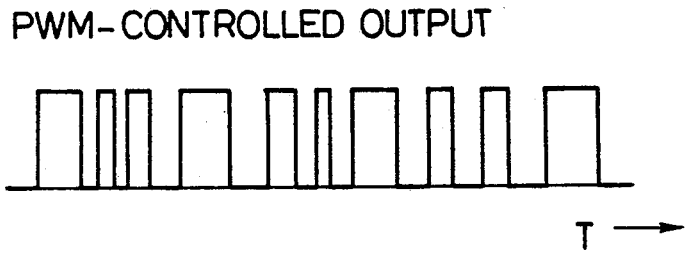
FIG. 20 is a waveform of the PWM-controlled signal from the PWM controller 310 shown in FIG. 18.

It should be noted that the output waveform of the PWM circuit 310 is represented in FIG. 20.

Figure 21:
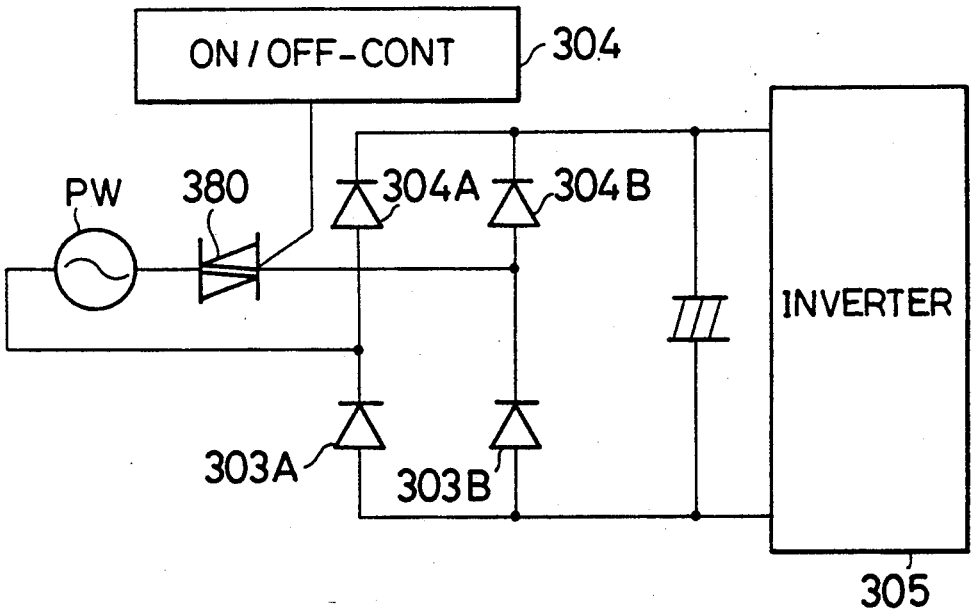
FIG. 21 is a circuit diagram of a modified rectifier circuit according to the invention; and, FIG. 22 is a schematic circuit diagram of an electromagnetic cooker 500 according to a seventh preferred embodiment of the invention, in which the inverter 305 is ON/OFF-controlled under the low power consumption.

Although the bridge circuit of thyristors 302 and diodes 303 was employed in the second to sixth preferred embodiments, the present invention is not limited thereto. For instance, a circuit arranged by a triac 380, the gate of which is connected to the ON/OFF controlling circuit 304, and also a diode bridge circuit 303A, 303B, 304A, 304B as represented by FIG. 21, may be utilized.

Seventh Electromagnetic Cooker

Figure 22:
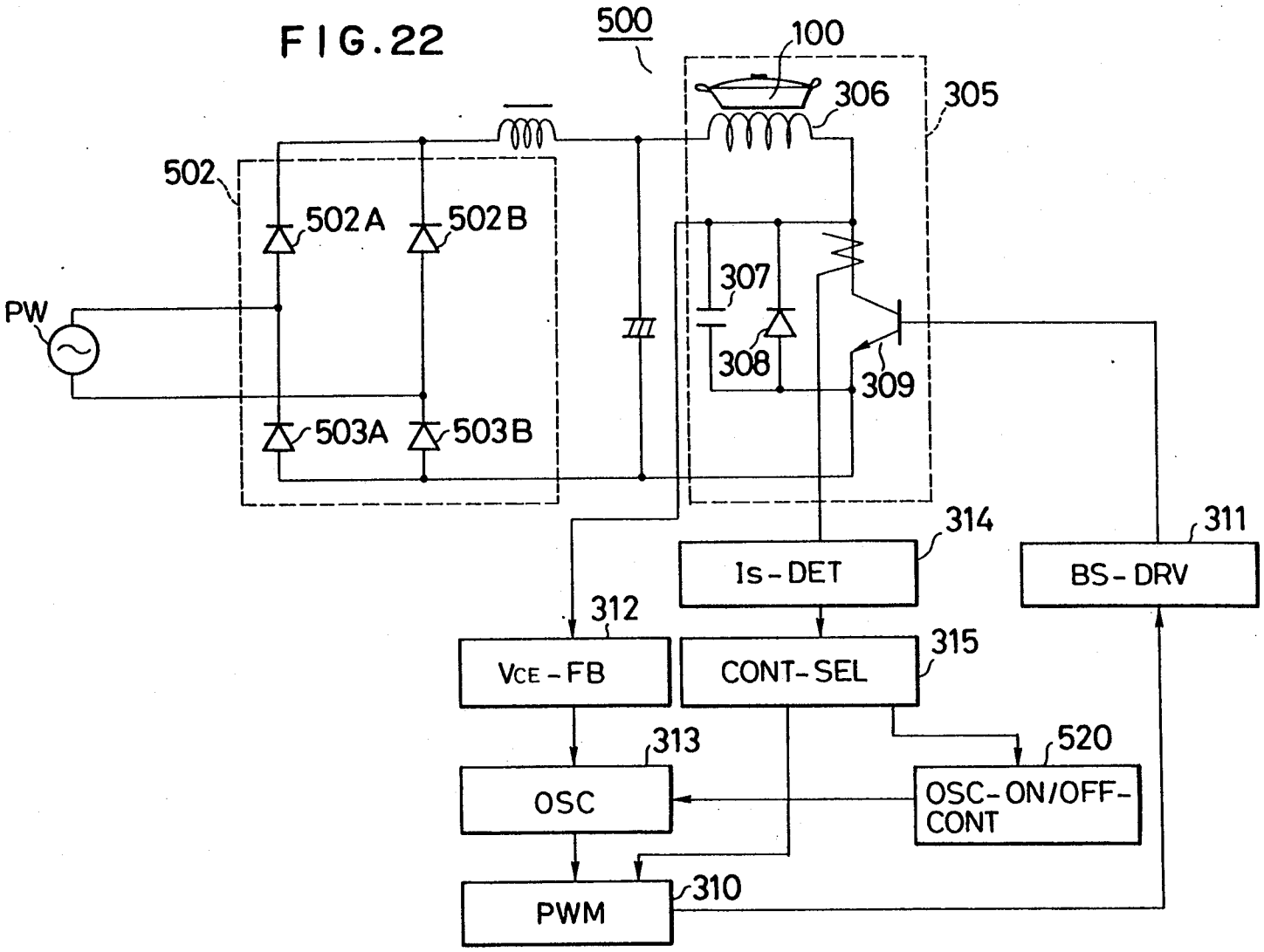

Referring to FIG. 22, an electromagnetic cooking apparatus 500 according to a seventh preferred embodiment will now be described, where a DC/AC inverter circuit is turned ON/OFF at a lower frequency, or at a switching period defined by a time constant smaller than a thermal time constant which is determined by the heat capacity of a material of a heatable pan.

As apparent from a circuit arrangement of FIG. 22, since this circuit arrangement is similar to that of the second preferred embodiment shown in FIG. 10, no further explanation on the similar circuit is made in the following descriptions.

In FIG. 22, an AC voltage applied from an AC power supply "PW" is rectified into a full wave form by a bridge rectifier circuit constructed of four diodes 502A, 502B, 503A and 503B. Thus, the resultant DC voltage is applied to a DC/AC inverter circuit 305. In accordance with the feature of the seventh preferred embodiment, an oscillator ON/OFF controlling circuit 520 for turning ON/OFF the oscillator circuit 313 is interposed between the control circuit selecting circuit 315 and the oscillator circuit 313.

In the sixth electromagnetic cooker 500 with the above-described circuit arrangement, when the short circuit current "$I_S$" of the switching transistor 309 in the DC/AC inverter circuit 305, the switching transistor 309 is controlled in the normal PWM control mode so as to control the output power of the inverter circuit 305.

To the contrary, when the short circuit current "$I_S$" becomes large, the oscillator ON/OFF controlling circuit 520 is actuated, so that the desired low output control is achieved by turning ON/OFF the oscillator circuit 310.

In other words, the oscillator circuit 313 is turned ON/OFF, based upon a time constant smaller than the thermal time constant determined by the heat capacity of the material of the pan 100, e.g., the time constant defined by the time period of the AC power supply "PW" by employing the oscillator ON/OFF control circuit 520. As a consequence, the uniform heating process without temperature fluctuations can be realized even under the lower output power from the DC/AC inverter circuit.

Although the AC power supply with 100 V or 200 V was employed in the preferred embodiments, another AC power supply with other supply voltages may be utilized. In particular, when the power supply voltage is higher than 100 V, the above-described advantages of the present invention are conspicuous.

Furthermore, since the zerocross switching operation is performed for the ON/OFF control, no excess short circuit current flows through the switching transistor at a high speed, so that the breakdown of the switching transistor can be prevented.

While has been described in detail, according to second to seventh preferred embodiments, the rectifier circuit is turned ON/OFF at a predetermined timing similar to the frequency of the AC power supply under the lower input power to the heating coil. As a consequence, such an electromagnetic cooking apparatus having the higher cooking capabilities can be provided.

We claim:

1. An electromagnetic cooking apparatus comprising:

DC (direct current) power supply means for producing DC power from low-frequency AC (alternating current) power;

DC-to-AC inverting means coupled to the DC power supply means and including a switching element and a heating coil, for inverting the DC power inputted from the DC power supply means into high-frequency AC power so as to heat an article by energizing the heating coil with the high-frequency AC power, thereby electromagnetically inducing eddy currents within the article;

monitoring means for monitoring the DC power inputted into the DC/AC inverting means so as to produce a DC input power signal;

setting means coupled to the DC/AC inverting means, for setting an ON-time duration of the switching element; and, judging means for judging whether or not the article to be heated corresponds to a heatable load electromagnetically loaded on the heating coil in response to the DC input power signal produced from the monitoring means after a predetermined time duration has passed from a beginning of the ON-time duration, thereby controlling the inverting operation of the DC/AC inverting means.

2. An electromagnetic cooking apparatus as claimed in claim 1, further comprising:

input controlling means coupled to the DC/AC inverting means, for receiving switching conditions of the switching element to output an input controlling signal; and, ON/OFF-controlling means interposed between the input controlling means and DC power supply means, for turning ON/OFF the power suppply operation of the DC power supply means in response to the input controlling signal at a timing period defined by a time constant smaller than a thermal time constant determined by a heat capacity of a material of the article.

3. An electromagnetic cooking apparatus as claimed in claim 2, wherein said ON/OFF-controlling means includes:

a triac interposed between the DC power supply means and an AC power source for supplying the low-frequency AC power; and, a trigger circuit for generating a trigger pulse in response to the input controlling signal, so as to trigger a ate of the triac, whereby the production of DC power by the DC power supply means is turned ON/OFF.

4. An electromagnetic cooking apparatus as claimed in claim 1, wherein said DC/AC inverting means further includes:

a resonance capacitor series-connected to the switching element so as to form a series resonance circuit.

5. An electromagnetic cooking apparatus as claimed in claim 1, wherein said switching element is a bipolar transistor.

6. An electromagnetic cooking apparatus as claimed in claim 1, wherein said switching element is an insulated-gate bipolar transistor.

7. An electromagnetic cooking apparatus as claimed in claim 1, further comprising:

an oscillation stopping timer for setting a stopping time period of the DC/AC inverting circuit so as to stop the inverting operation of the DC/AC inverting circuit for a predetermined stopping time period; and, a load detecting timer for producing a load detecting timer signal after the stopping time period, so as to prohibit judgment operation by the judging means for a predetermined prohibit time period, whereby the judgment operation by the judging means is carried out after the prohibit time period within the ON-time duration.

8. An electromagnetic cooking apparatus as claimed in claim 7, wherein said stopping time period is selected to be approximately 3 seconds, and said prohibit time period is selected to be about 10 milliseconds, and the ON-time duration is selected to be approximately 3.03 seconds.

9. An electromagnetic cooking apparatus as claimed in claim 1, wherein said DC/AC inverting means further includes:

a pulse width modulation drive circuit for driving the switching element in a pulse width modulation mode, the pulse width of which is modulated, based upon the ON-time duration of the switching element.

10. An electromagnetic cooking apparatus (200) as claimed in claim 1, wherein said DC power supply means includes:

a bridge circuit constructed of two diodes and two thyristors.

11. An electromagnetic cooking apparatus comprising:

DC (direct current) power supply means for producing DC power from low-frequency AC (alternating current) power;

DC-to-AC inverting means coupled to the DC power supply means and including a switching element and also a heating coil, for inverting the DC power inputted from the DC power supply means into high-frequency AC power so as to heat an article by energizing the heating coil with the high-frequency AC power, thereby electromagnetically inducing eddy currents within the article;

monitoring means for monitoring switching conditions of the switching element so as to output a switching condition signal; and, ON/OFF-controlling means for turning ON/OFF power supply operation of the DC power supply means in response to the switching condition signal at a timing period defined by a time constant smaller than a thermal time constant determined by a heat capacity of a material of the article.

12. An electromagnetic cooking apparatus as claimed in claim 11, wherein said DC/AC inverting means further includes:

a resonance capacitor series-connected to the switching element so as to form a series resonance circuit.

13. An electromagnetic cooking apparatus as claimed in claim 11, wherein said switching element is a bipolar transistor.

14. An electromagnetic cooking apparatus as claimed in claim 11, wherein said switching element is an insulated-gate bipolar transistor.

15. An electromagnetic cooking apparatus as claimed in claim 11, wherein said switching condition monitoring means includes:

a short circuit current detecting circuit for detecting a short circuit current flowing through the switching element so as to produce the switching condition signal.

16. An electromagnetic cooking apparatus as claimed in claim 11, wherein said ON/OFF-controlling means is operated in a zerocross switching mode.

17. An electromagnetic cooking apparatus as claimed in claim 11, wherein said DC/AC inverting means further includes:

a pulse width modulation drive circuit for driving the switching element in a pulse width modulation mode, the pulse width of which being modulated in response to the switching condition signal.

18. An electromagnetic cooking apparatus as claimed in claim 17, further comprising:

control circuit selecting circuit for alternatively selecting one of said pulse width modulation circuit and ON/OFF-controlling means based upon the switching condition signal derived from the switching condition monitoring means.

19. An electromagnetic cooking apparatus as claimed in claim 17, further comprising:

an output setting unit for setting an output of said DC/AC inverting means to produce an output setting signal; and, a control circuit selecting circuit for alternatively selecting one of said pulse width modulation circuit and ON/OFF-controlling means based upon the output setting signal.

20. An electromagnetic cooking apparatus as claimed in claim 17, further comprising:

an input current detecting circuit for detecting an input current flowing through an AC power source for supplying the low-frequency AC power; and, a control circuit selecting circuit for alternatively selecting one of said pulse width modulation circuit and ON/OFF-controlling means based upon the output setting signal.

21. An electromagnetic cooking apparatus as claimed in claim 20, wherein said input current detecting circuit includes:

a zerocross signal generator;

an analog-to-digital converter, a 4-bit binary counter, and a decoder.

22. An electromagnetic cooking apparatus as claimed in claim 11, wherein said DC power supply means includes:

a bridge circuit constructed of two diodes and two thyristors.

23. An electromagnetic cooking apparatus as claimed in claim 11, wherein said ON/OFF-controlling means includes:

interposed between the DC power supply means and an AC power source for supplying low-frequency AC power; and, a trigger circuit for generating a trigger pulse in response to the input controlling signal so as to trigger a gate of the triac, whereby the production of DC power by the DC power supply means is turned ON/OFF.

24. An electromagnetic cooking apparatus as claimed in claim 11, wherein said low frequency of the AC power is selected from 50 Hz to 60 Hz approximately, whereas said high frequency of the AC power is selected to be approximately 25 KHz.

25. An electromagnetic cooking apparatus comprising:

a DC (direct current) power supply means for producing DC power from low-frequency AC (alternating current) power;

DC-to-AC inverting means coupled to the DC power supply means and including a switching element and heating coil, for inverting the DC power inputted from the DC power supply means into high-frequency AC power so as to heat an article by energizing the heating coil with the high-frequency AC power, thereby electromagnetically inducing eddy currents within the article;

monitoring means for monitoring switching conditions of the switching element so as to output a switching condition signal; and, ON/OFF-controlling means for turning ON/OFF the inverting operation of the DC/AC inverting means in response to the switching condition signal at a timing period defined by a time constant less than a thermal time constant determined by a heat capacity of a material of the article.

26. An electromagnetic cooking apparatus as claimed in claim 25, wherein said DC/AC inverting means further includes:

a resonance capacitor series-connected to the switching element so as to form a series resonance circuit.

27. An electromagnetic cooking apparatus as claimed in claim 25, wherein said switching element is a bipolar transistor.

28. An electromagnetic cooking apparatus as claimed in claim 25, wherein said switching element is an insulated-gate bipolar transistor.

29. An electromagnetic cooking apparatus as claimed in claim 25, wherein said switching condition monitoring means includes:

a short circuit current detecting circuit for detecting it short circuit current flowing through the switching element so as to produce the switching condition signal.

30. An electromagnetic cooking apparatus as claimed in claim 25, further comprising:

a resonance voltage feedback circuit for receiving a resonance voltage form said switching element to output a resonance voltage feedback signal; and, an oscillator for oscillating a pulse width modulation signal in response to the resonance voltage feedback signal under the control of the ON/OFF-controlling means, the pulse width of which is modulated in response to the resonance voltage feedback signal.

31. An electromagnetic cooking apparatus as claimed in claim 25, further comprising:

a control circuit selecting circuit for alternatively selecting one of said pulse width modulation circuit and ON/OFF-controlling means based upon the switching condition signal derived from the switching condition monitoring means.

32. An electromagnetic cooking apparatus as claimed in claim 25, wherein said DC power supply means includes a bridge circuit constructed of four diodes.

33. An electromagnetic cooking apparatus as claimed in claim 25, wherein said low frequency of the AC power is selected from 50 Hz to 60 Hz approximately, whereas said high frequency of the AC power is selected to be approximately 25 KHz.

* * * * *